US010164330B2

(12) United States Patent
Wu et al.

(10) Patent No.: US 10,164,330 B2
(45) Date of Patent: Dec. 25, 2018

(54) ANTENNA ASSEMBLY AND SELF-CURING DECOUPLING METHOD FOR REDUCING MUTUAL COUPLING OF COUPLED ANTENNAS

(71) Applicant: The Chinese University of Hong Kong, Shatin, New Territories, Hong Kong (CN)

(72) Inventors: Ke-Li Wu, Hong Kong (CN); Jiangwei Sui, Nanyang (CN); Dacheng Wei, Guangzhou (CN)

(73) Assignee: The Chinese University of Hong Kong, Shatin, N.T., Hong Kong SAR (CN)

( * ) Notice: Subject to any disclaimer, the term of this patent is extended or adjusted under 35 U.S.C. 154(b) by 68 days.

(21) Appl. No.: 15/295,552

(22) Filed: Oct. 17, 2016

(65) Prior Publication Data

US 2018/0108984 A1 Apr. 19, 2018

(51) Int. Cl.

| | |
|---|---|
| ***H01Q 1/52*** | (2006.01) |
| ***H01Q 5/392*** | (2015.01) |
| ***H01Q 9/04*** | (2006.01) |
| ***H01Q 9/42*** | (2006.01) |
| ***H01Q 5/371*** | (2015.01) |

(52) U.S. Cl.

CPC ..... *H01Q 1/52* (2013.01); *H01Q 1/521* (2013.01); *H01Q 5/371* (2015.01); *H01Q 5/392* (2015.01); *H01Q 9/0421* (2013.01); *H01Q 9/42* (2013.01)

(58) Field of Classification Search

CPC ..... H01Q 1/48; H01Q 1/243; H01Q 9/0421; H01Q 1/52; H01Q 1/24; H01Q 5/932

USPC ..... 343/846, 702, 850

See application file for complete search history.

(56) References Cited

U.S. PATENT DOCUMENTS

2003/0098813 A1* 5/2003 Koskiniemi ..... H01Q 9/0421 343/702

2008/0094302 A1* 4/2008 March ..... H01Q 1/48 343/846

* cited by examiner

*Primary Examiner* — Jessica Han
*Assistant Examiner* — Hai V Tran
(74) *Attorney, Agent, or Firm* — Kilpatrick Townsend & Stockton LLP

(57) ABSTRACT

The disclosure provides antenna assemblies and methods for reducing mutual coupling of coupled antennas. According to an embodiment, the antenna assembly, comprises: a first antenna; and a second antenna coupled with the first antenna; wherein a first capacitive load is provided to the first antenna at a first position of the first antenna so that a mutual coupling between the first antenna and the second antenna is reduced. According to the present disclosure, at least some of the following advantages may be achieved: 1) no any component that connects or structure between coupled antennas is required; 2) the capacitive load is very little frequency dependent so that the method is highly suitable for antenna decoupling at low frequencies; 3) the required capacitive load takes almost no space in the circuit layout; and 4) the load does not noticeably change antenna radiation patterns.

22 Claims, 21 Drawing Sheets

ANTENNA ASSEMBLY AND SELF-CURING DECOUPLING METHOD FOR REDUCING MUTUAL COUPLING OF COUPLED ANTENNAS

TECHNICAL FIELD

This application relates to wireless communication devices, in particular, to antenna assemblies and methods for reducing mutual coupling of coupled antennas.

BACKGROUND

In order to satisfy the demands of various wireless services, more and more antennas are accommodated in one physically compact mobile terminal. Accordingly, the signal isolation between antennas becomes more and more insufficient, which causes severe radio frequency interferences among the collocated antennas. In fact, such coexistence interferences impact almost all modern wireless communication devices. Taking a mobile phone or a wireless router for instance, various communication systems, including 2G (GSM), 3G (UMTS), 4G (LTE), Wi-Fi, GPS and Bluetooth, coexist in a very compact volume, and operating frequency bands of which are very close to each other. Thus, the mutual coupling between antennas is severe, which leads to a low radiation efficiency of the antennas. Even worse, when mutual coupling is strong, the power will be coupled from one antenna to other antennas rather than radiating to free space, thus decreasing the signal-to-noise ratio and data throughput. These effects will eventually deteriorate the performance of the collocated systems which operate in adjacent frequency bands.

Using multiple antennas is also an effective way to overcome fading effect and to increase the spectrum efficiency. There are two main applications: Spatial (or polarization) diversity is used to enhance the reliability of the system with respect to various of fading; and Spatial multiplexing is used to provide additional data capacity by utilizing the different uncorrelated paths to carry additional data streams. The latter is referred to as Multiple Input Multiple Output (MIMO) data access scheme.

When multiple antennas are implemented, inverted F antenna (IFA), loop and monopole antennas are three popular antenna forms used in mobile terminals due to their simplicity and compactness in structure, flexibility in design and multiple-band options.

Nevertheless, no matter what antenna form is used, because of the compact volume of a mobile terminal and co-existence of many antennas, severe mutual couplings among the multiple antennas will inevitably decrease the Signal-Noise-Ratio (SNR) and increase the signal correlation. Additionally, a strong mutual coupling also lowers the radiation efficiency. All of these negative effects decrease the superiority of a multiple antenna system and deteriorate the system performance.

There are mainly four categories of known decoupling methods: 1) adding a neutralization line between two coupled antennas to reduce the mutual coupling; 2) destroying the ground plane between two coupled antennas to alert the current on the ground between two coupled antennas; 3) inserting parasitic elements between coupled antennas; and 4) introducing a decoupling network either shunt connected between the coupled antennas or cascade connected between coupled antenna ports and transmitter/receiver ports.

Though these approaches can help to improve the isolation between two antennas, many of them are ad-hoc to a specific antenna configuration and they all require to introduce either an interconnecting circuit or an electromagnetic structure between two antennas. This requirement either increases the whole footprint in antenna layout or interconnects two antennas by a block of structure, all in a dimension of a large fraction of wavelength. All these approaches are difficult to implement in most of practical mobile terminals. Such situation is more challenging at low frequencies. The concurrent trends of a wireless terminal tend to have a less clearance for antennas and more collocated antennas, which severely limits the use of these existing decoupling schemes in practical applications. It is clear that having a decoupling method that has no physical connection between two coupled antennas and occupies virtually no extra space will be highly appreciated by the industry, not mentioning that if the decoupling method is simple to implement.

SUMMARY

In one aspect, the present application provides an antenna assembly, comprising: a first antenna; and a second antenna coupled with the first antenna; wherein a first capacitive load is provided to the first antenna at a first position of the first antenna so that a mutual coupling between the first antenna and the second antenna is reduced.

In another aspect, the present application provides a method for reducing mutual coupling of an antenna assembly including a first antenna and a second antenna coupled with the first antenna, the method comprising: providing a first capacitive load to the first antenna at a first position of the first antenna so that a mutual coupling between the first antenna and the second antenna is reduced.

In a further aspect, the present application provides an antenna, comprising: a capacitive load provided at a position near a shorting end of the antenna.

DRAWINGS

FIG. 7(*b*) illustrates the simulated and measured S-parameters of two tail-to-tail IFA antennas on the same edge with the capacitive loads.

FIGS. 8(*b*), 8(*c*) and 8(*d*) illustrate the measured radiation patterns of the coupled and decoupled antennas in case 1 in the x-y plane, x-z plane and y-z plane, respectively.

Figure 9:
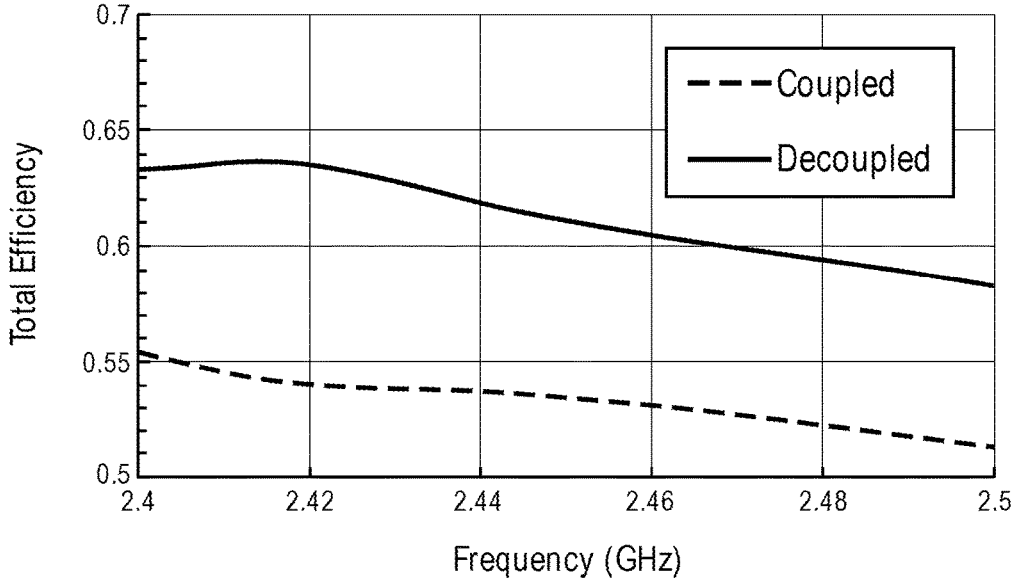

FIG. 9 illustrates a comparison between the measured total efficiency of the coupled and decoupled IFA antennas in case 1.

Figure 10:
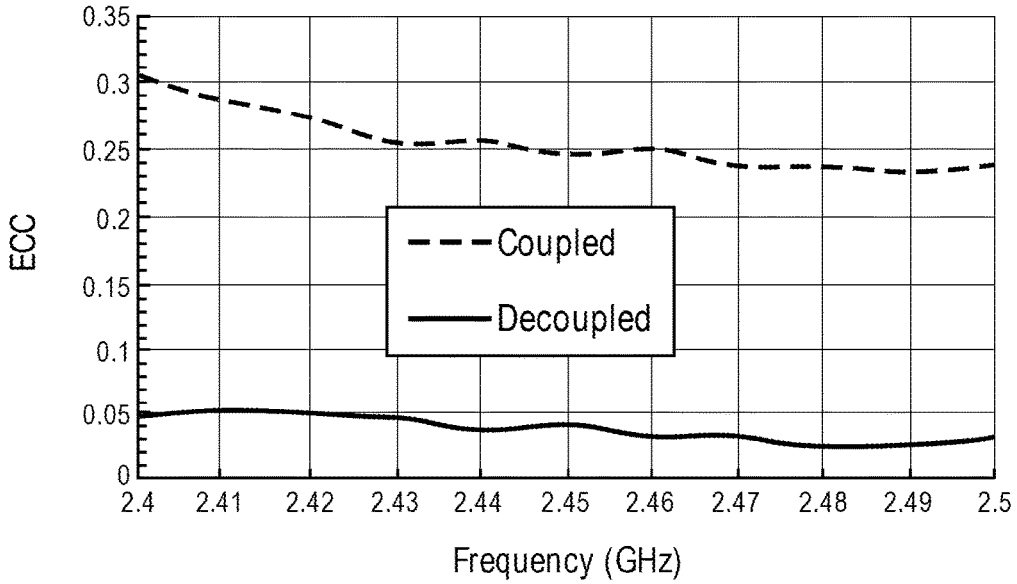

FIG. 10 illustrates the measured Envelope Correlation Coefficient (ECC) of the coupled and decoupled IFA antennas in case 1.

Figure 11:
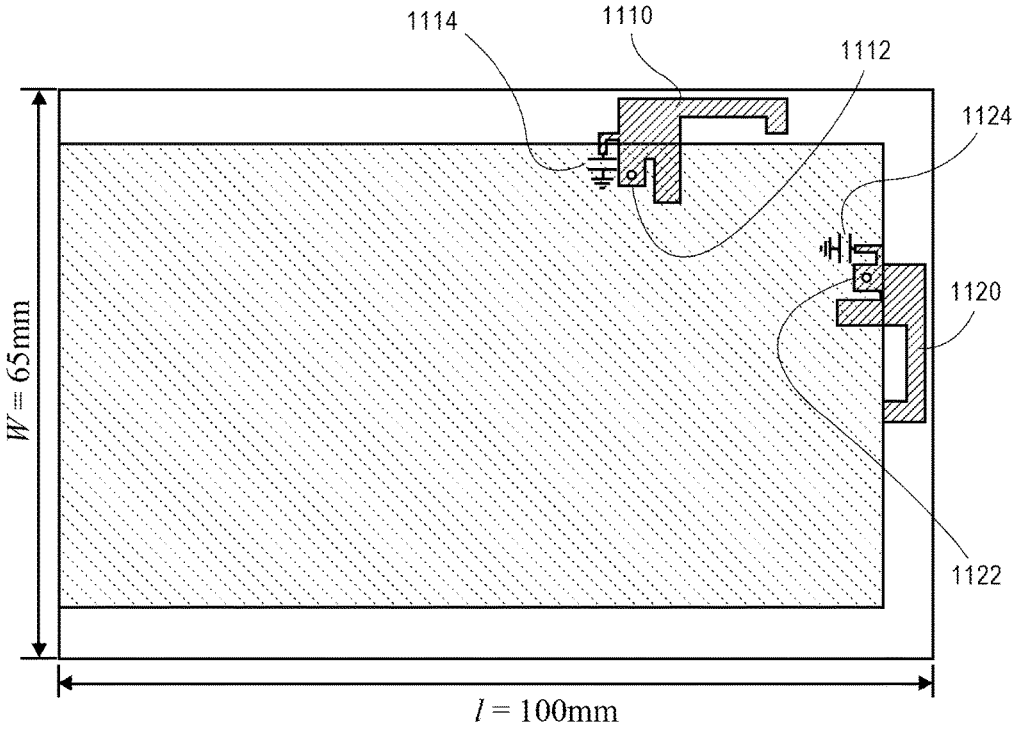

FIG. 11 illustrates the head-to-tail arrangement of two IFA antennas on two perpendicular edges in case 2 with capacitive loads.

Figure 12A:
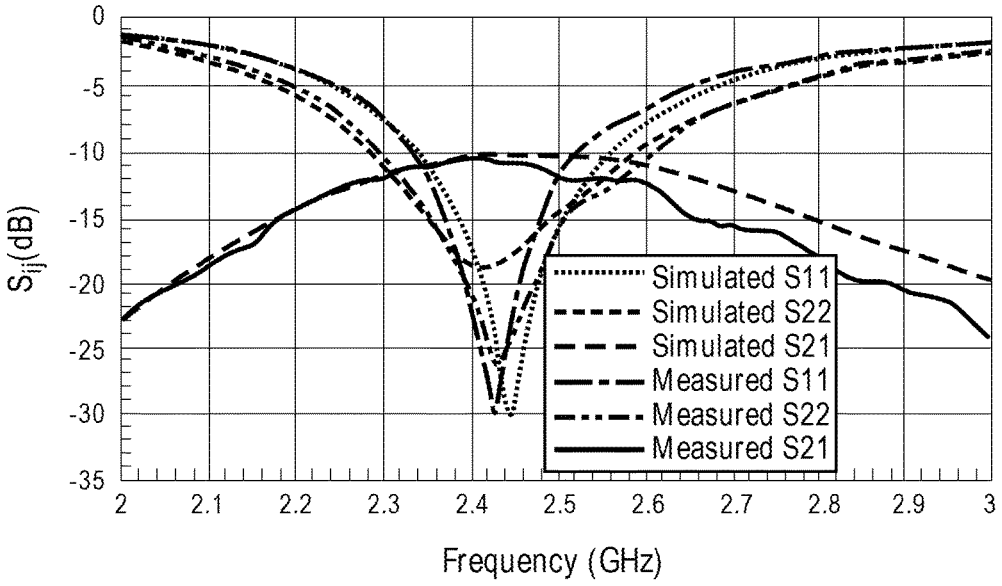
Figure 12B:
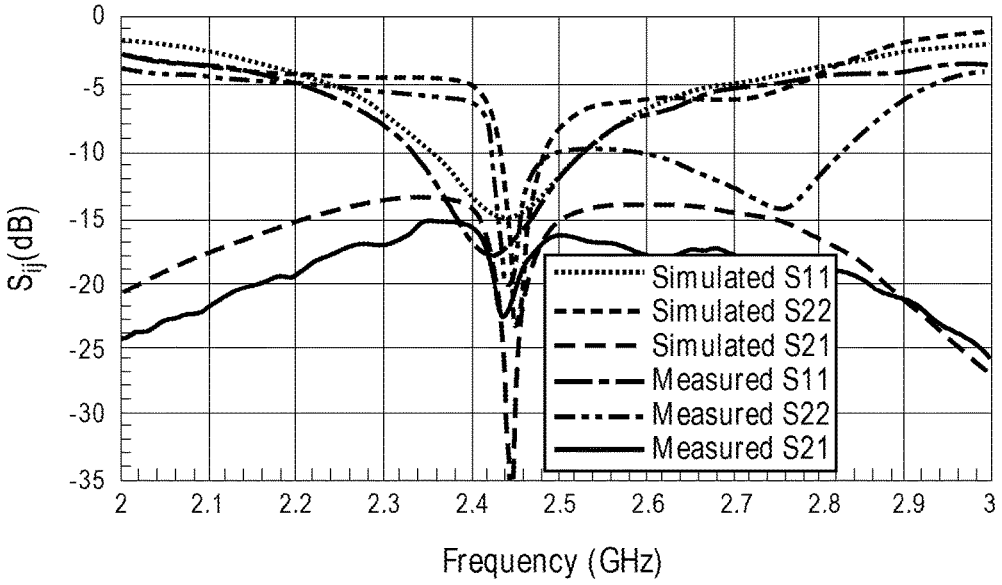

FIG. 12(*a*) illustrates the simulated and measured S-parameters of two tail-to-tail IFA antennas on the same edge without the capacitive loads.

FIG. 12(*b*) illustrates the simulated and measured S-parameters of two tail-to-tail IFA antennas on the same edge with the capacitive loads.

Figure 13:
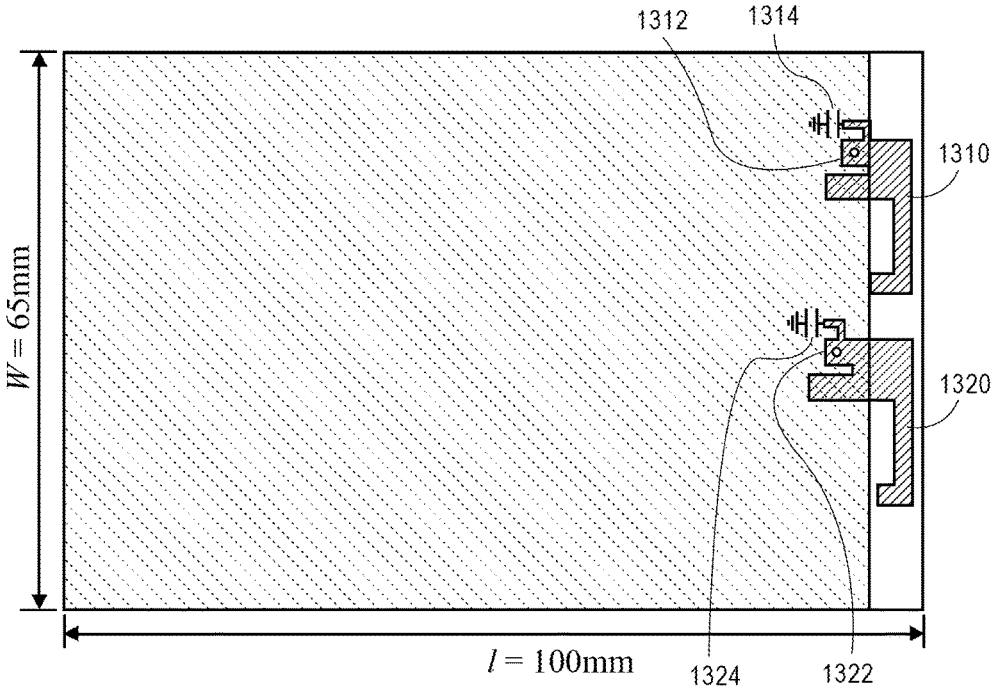

FIG. 13 illustrates the head-to-tail arrangement of two IFA antennas on the same edge in case 3 with capacitive loads.

Figure 14:
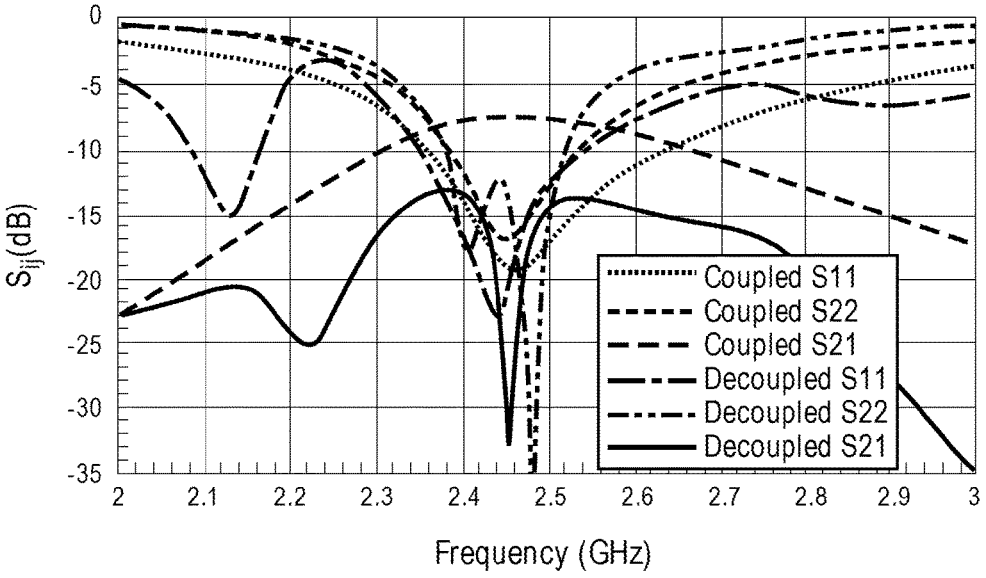

FIG. 14 illustrates the simulated S-parameters of coupled and decoupled two head-to-tail IFA antennas on the same edges.

Figure 15:
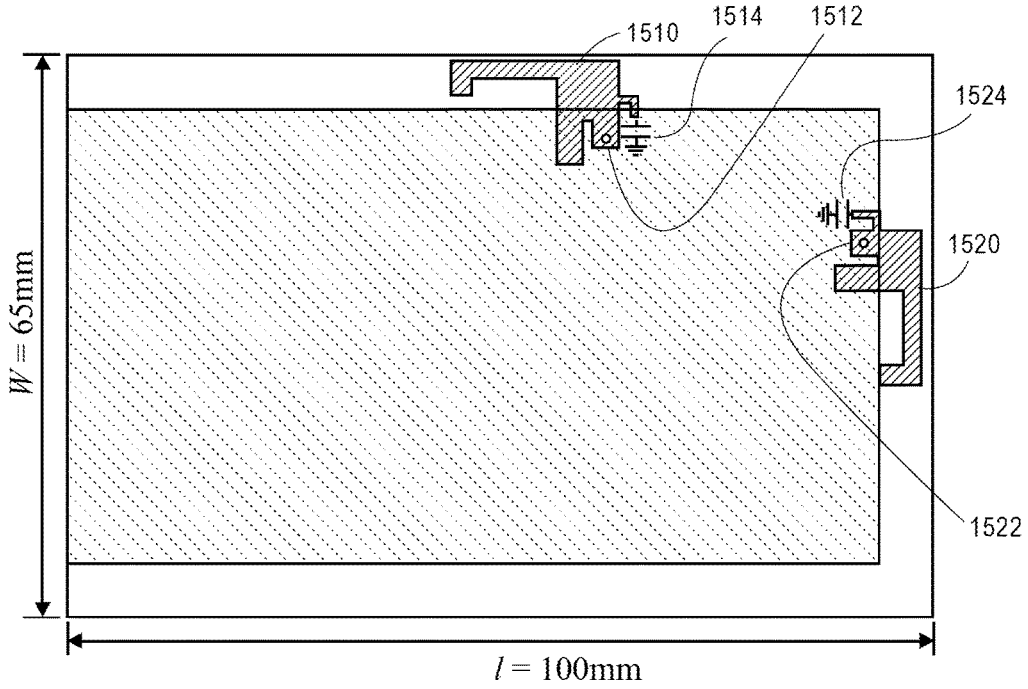

FIG. 15 illustrates the tail-to-tail arrangement of two IFA antennas on two perpendicular edges in case 4 with capacitive loads.

Figure 16:
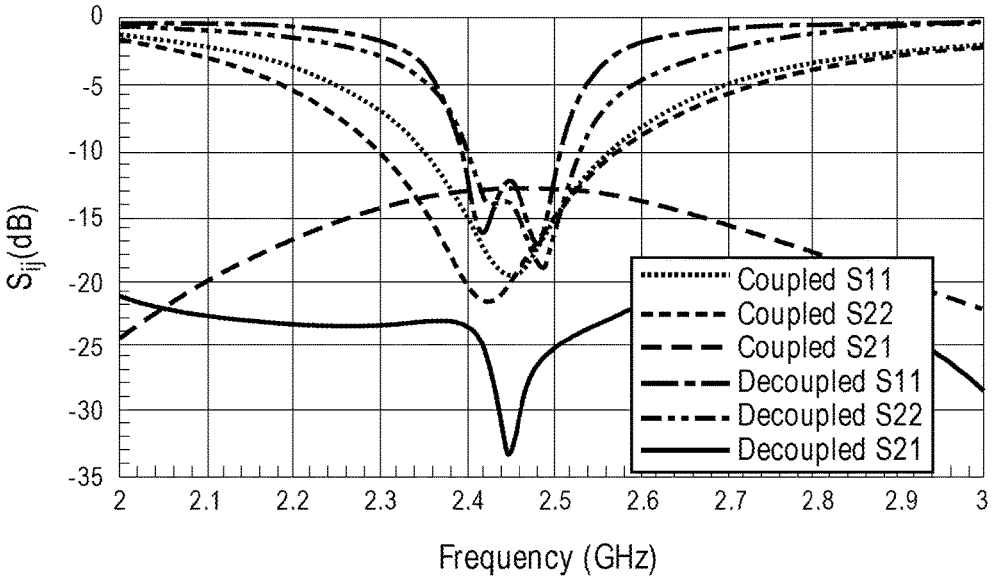

FIG. 16 illustrates the simulated S-parameters of coupled and decoupled two tail-to-tail IFA antennas on two perpendicular edges.

Figure 17:
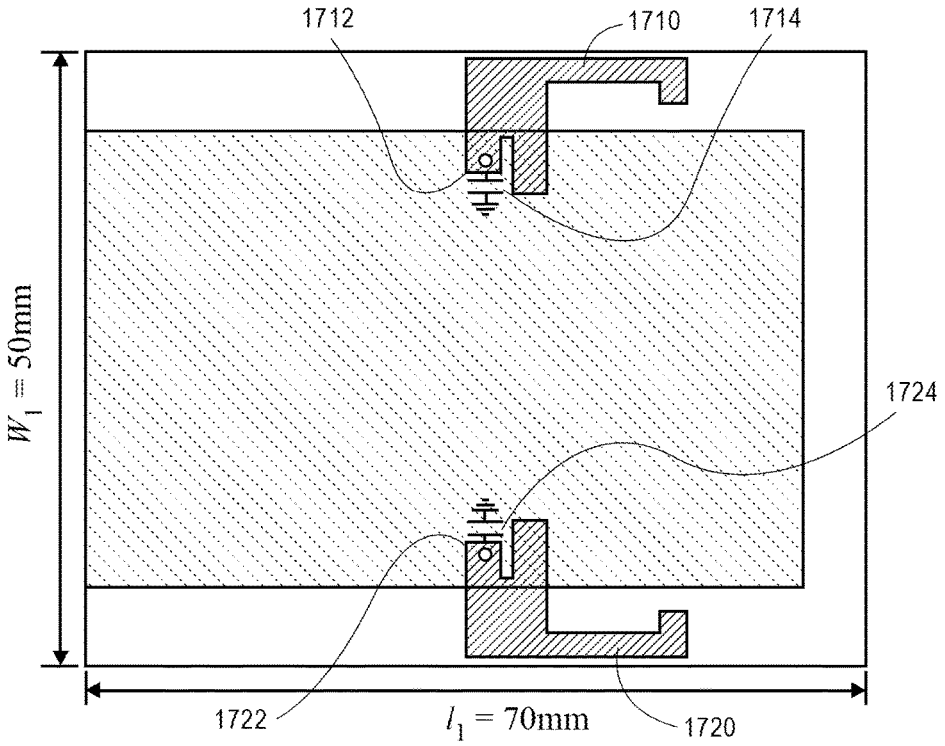

FIG. 17 illustrates the arrangement of two IFA antennas in the same orientation and on two opposite edges in case 5 with capacitive loads.

Figure 18:
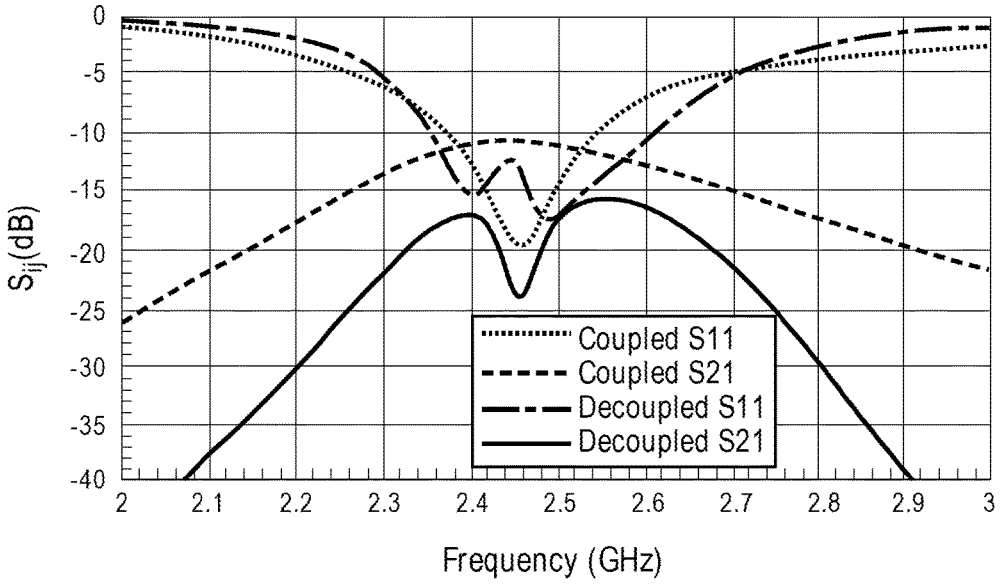

FIG. 18 illustrates the simulated S-parameters of coupled and decoupled two IFA antennas in the same orientation and on two opposite edges.

Figure 19:
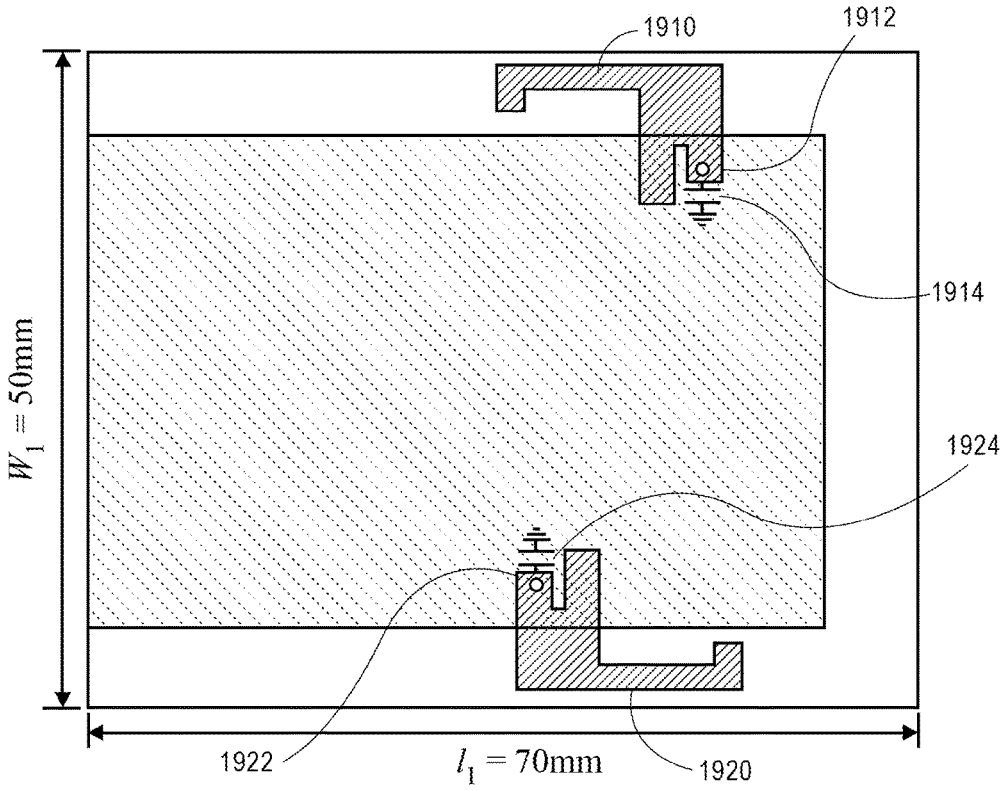

FIG. 19 illustrates the arrangement of two IFA antennas in opposite orientations and on two opposite edges in case 6 with capacitive loads.

Figure 20:
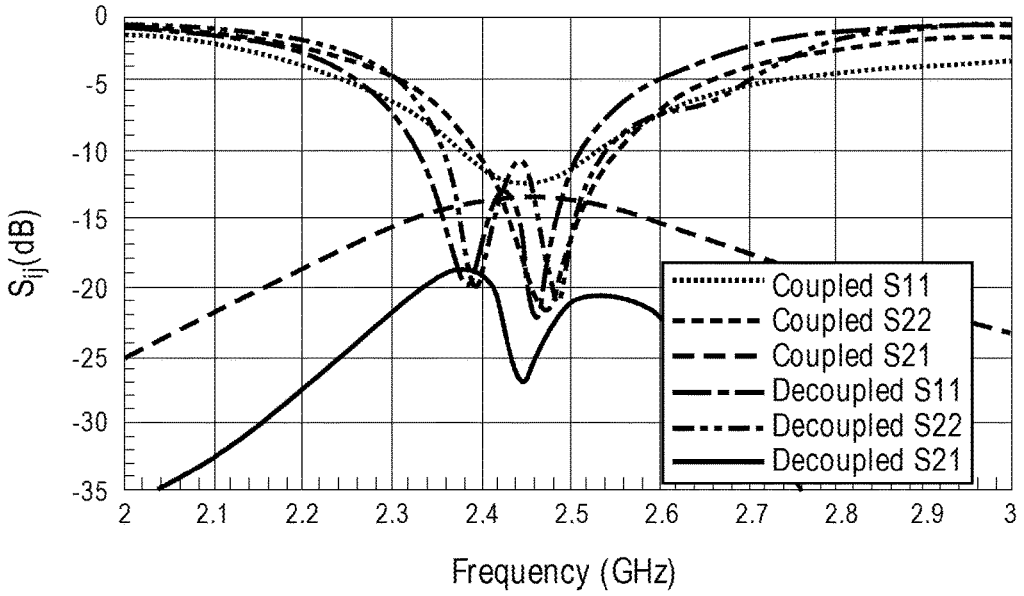

FIG. 20 illustrates the simulated S-parameters of coupled and decoupled two IFA antennas in opposite orientations and on two opposite edges.

Figure 21:
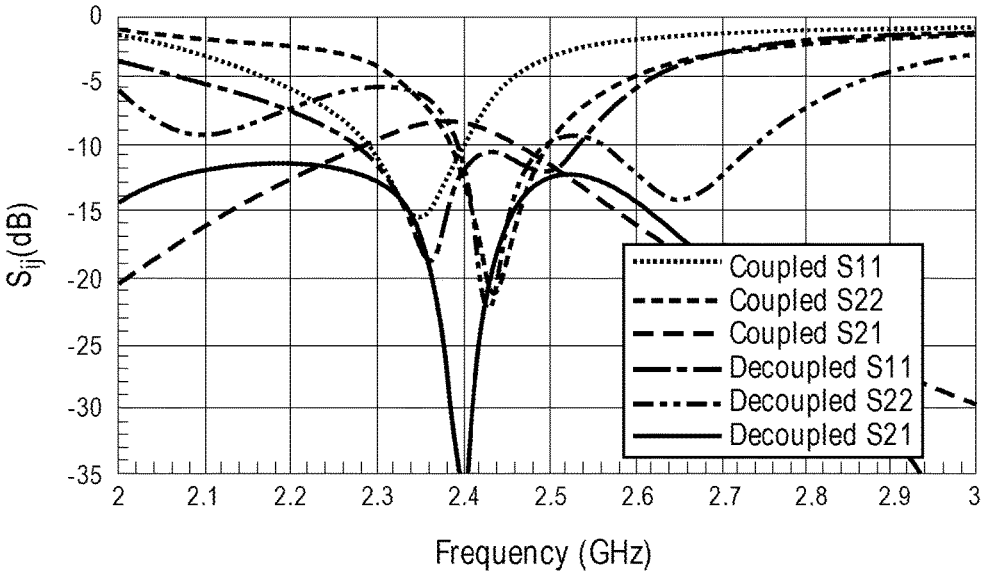

FIG. 21 shows the simulated S-parameters of two coupled and decoupled IFA antennas operating in two adjacent bands.

Figure 22:
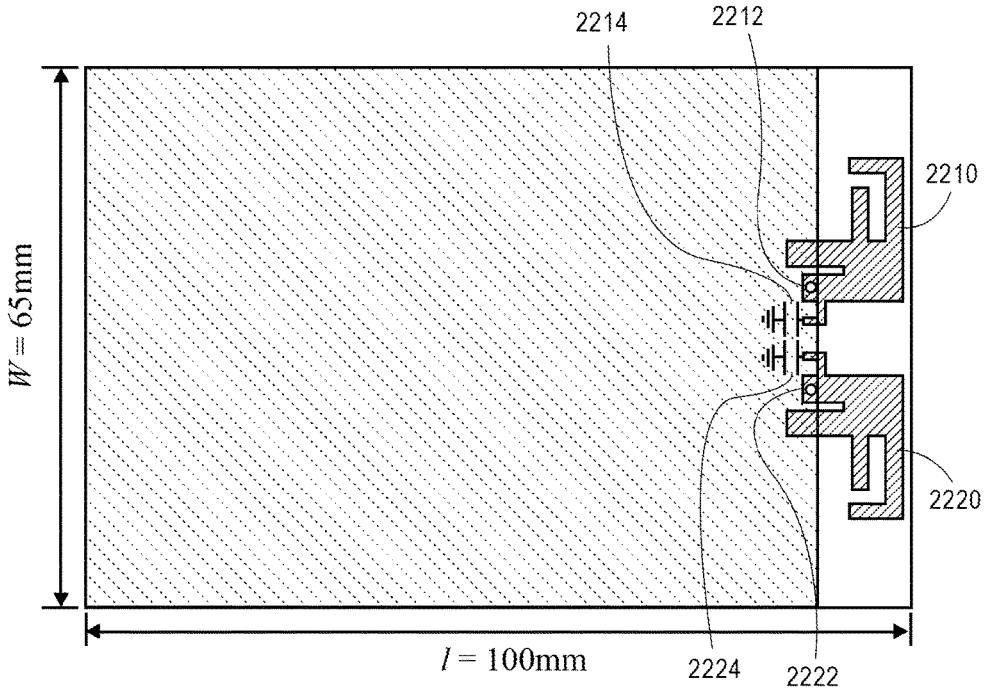

FIG. 22 illustrates the same edge tail-to-tail arrangement of two dual-band IFA antennas with capacitive loads.

Figure 23:
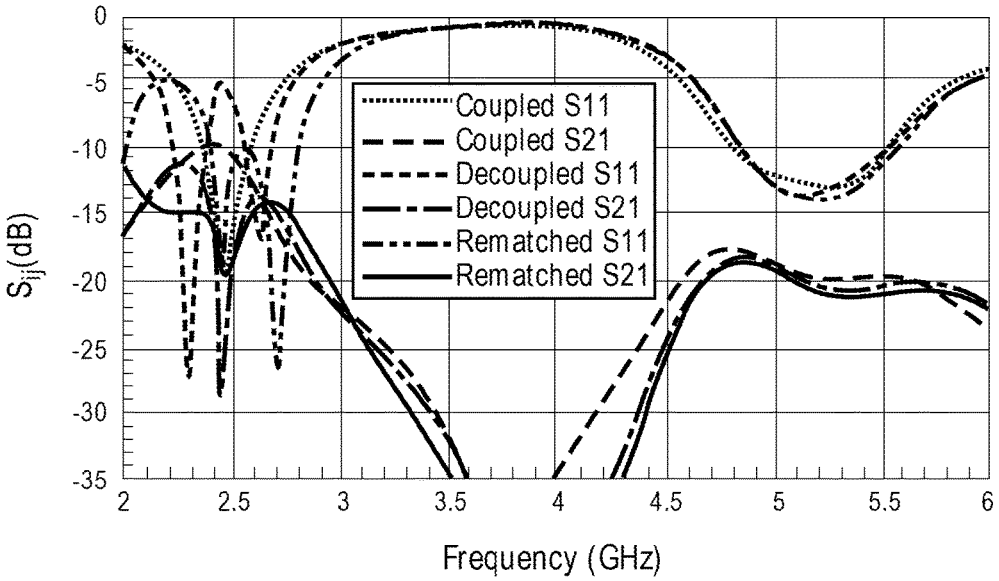

FIG. 23 illustrates the simulated S-parameters of two coupled and decoupled tail-to-tail on same edge dual-band IFA antennas.

Figure 24A:
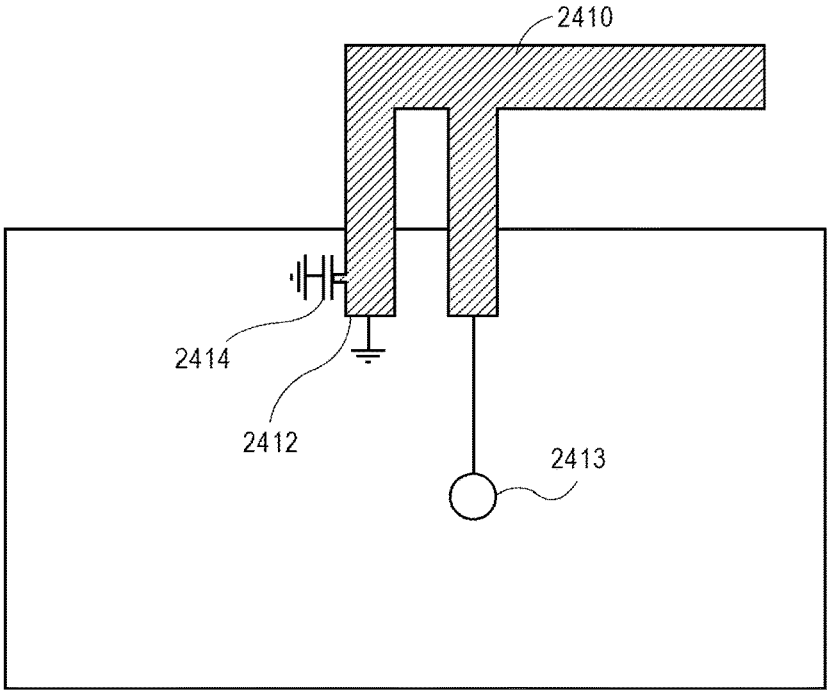
Figure 24B:
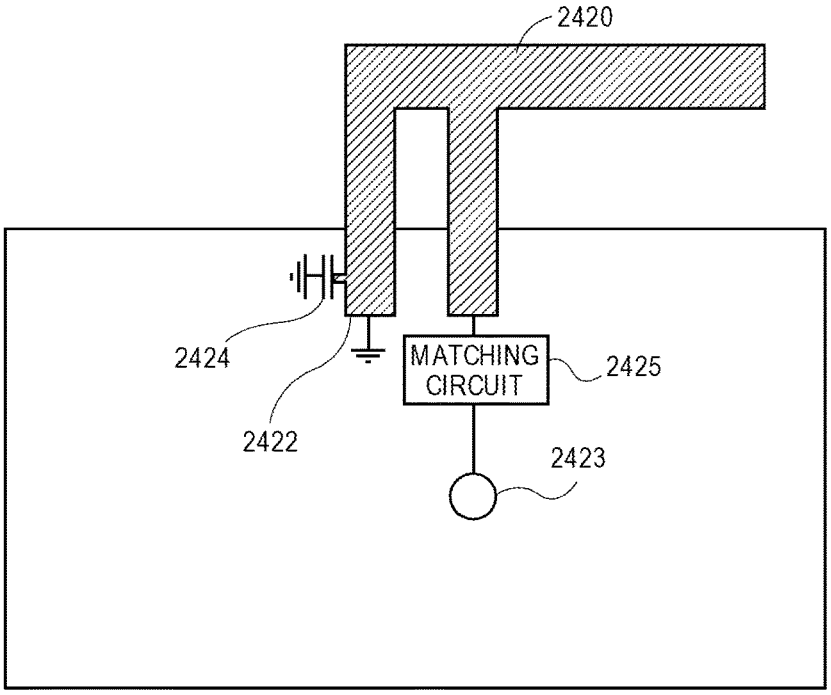

FIG. 24(*a*) illustrates the configurations of an IFA antenna with a capacitive load for dual-band applications.

FIG. 24(*b*) illustrates the configurations of an IFA antenna with a capacitive load for wide-band applications.

Figure 25:
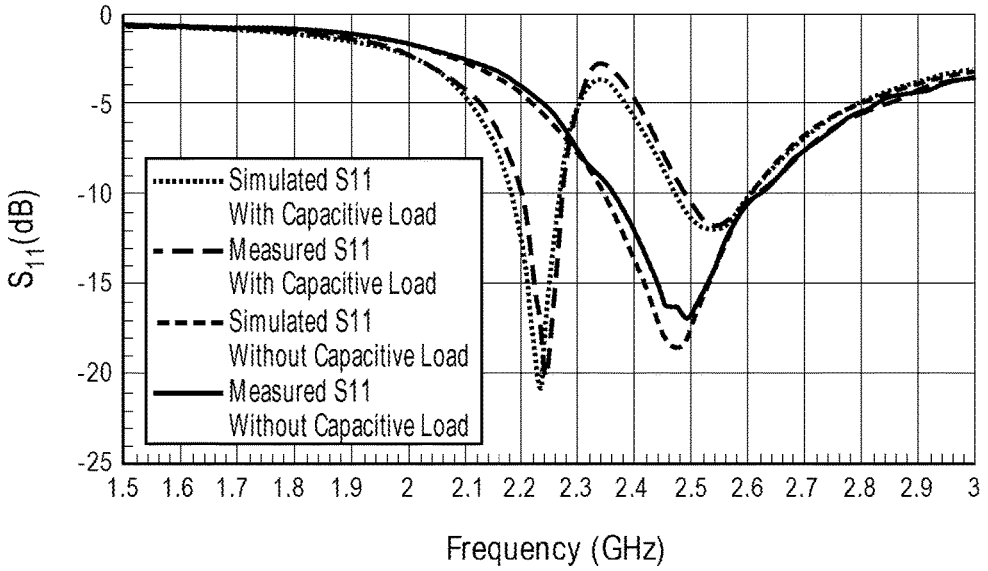

FIG. 25 illustrates the simulated S-parameters of a conventional IFA antenna and its variation with a capacitive load as a dual-band IFA antenna.

Figure 26:
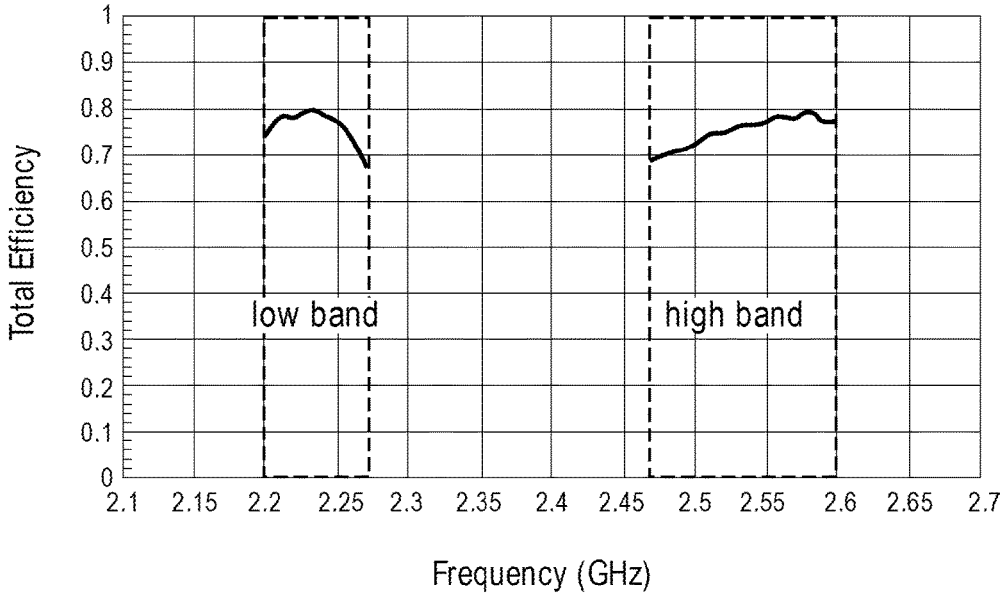

FIG. 26 illustrates the measured total efficiency of the dual-band IFA antenna with capacitive load.

Figure 27:
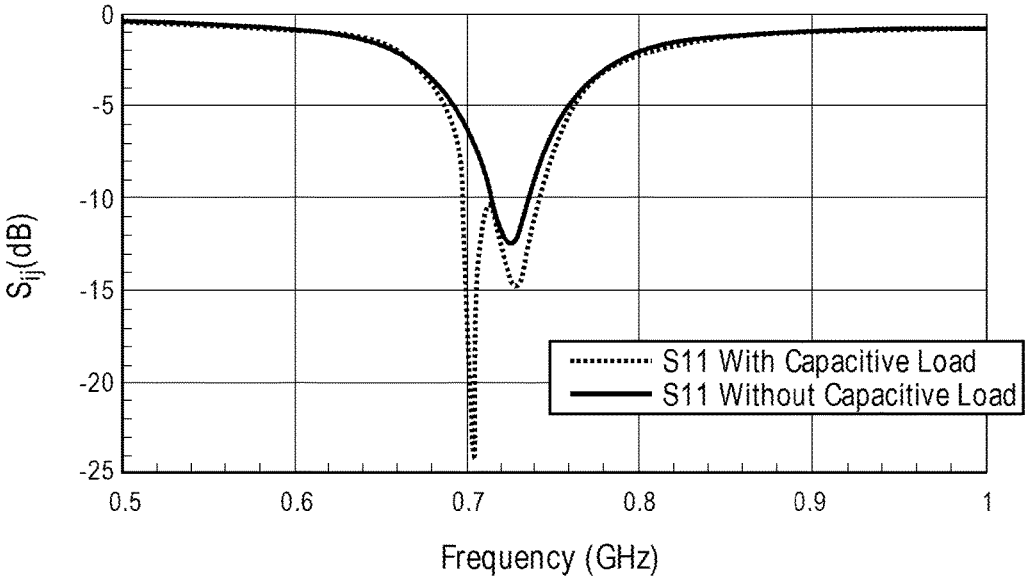

FIG. 27 illustrates the simulated S-parameters of a conventional IFA antenna and its variation with a capacitive load as a wide-band IFA antenna.

Figure 28:
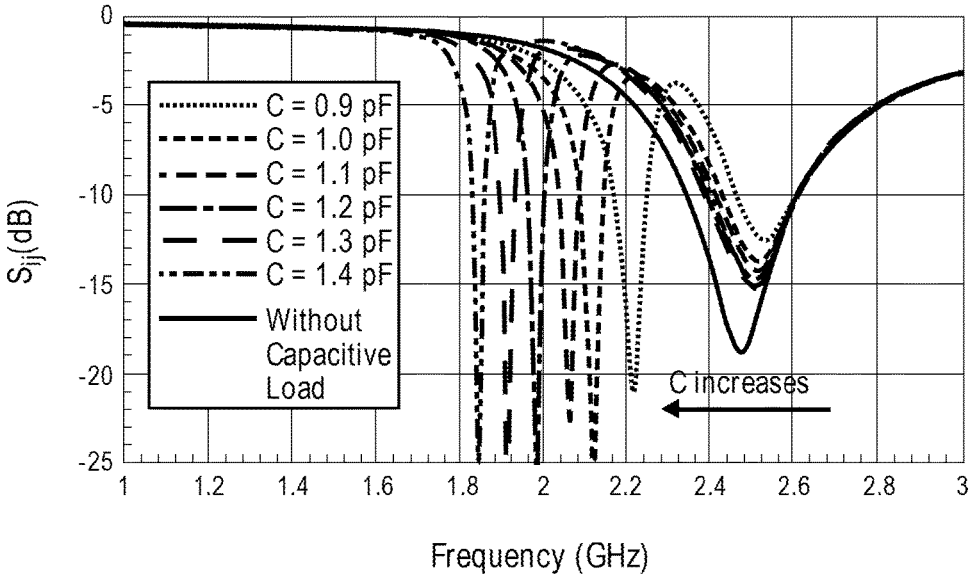

FIG. 28 illustrates the simulated S-parameters of a conventional IFA antenna and its variation with a tunable capacitive load as a tunable IFA antenna.

Figure 2:
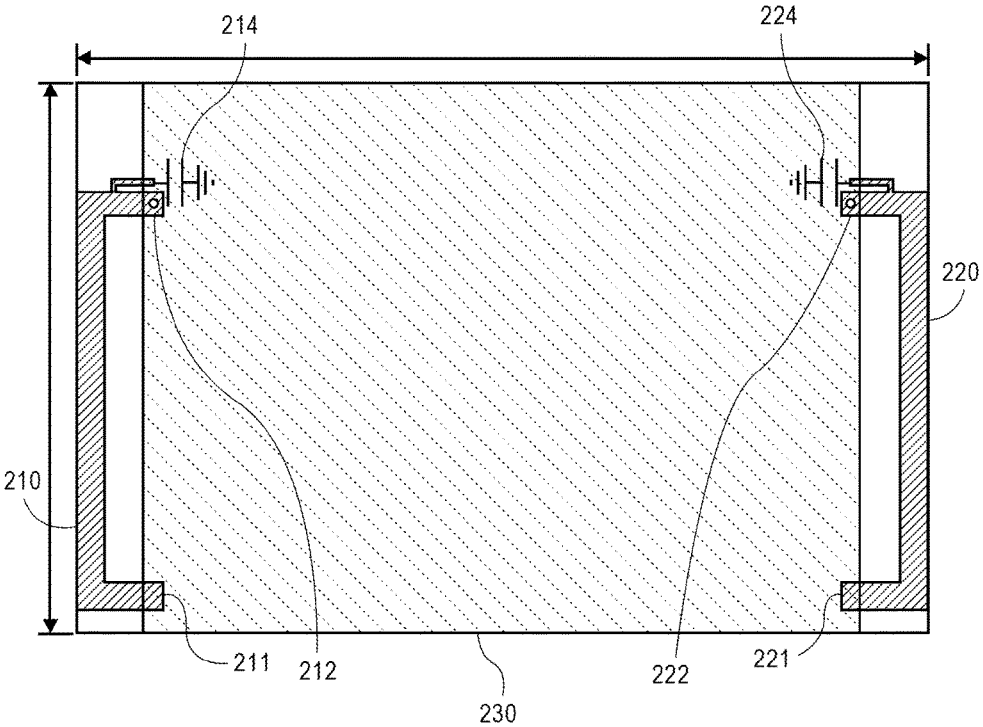
FIG. 2 illustrates a schematic view of two coupled semi-loop antennas according to an embodiment of the present application.
Figure 29:
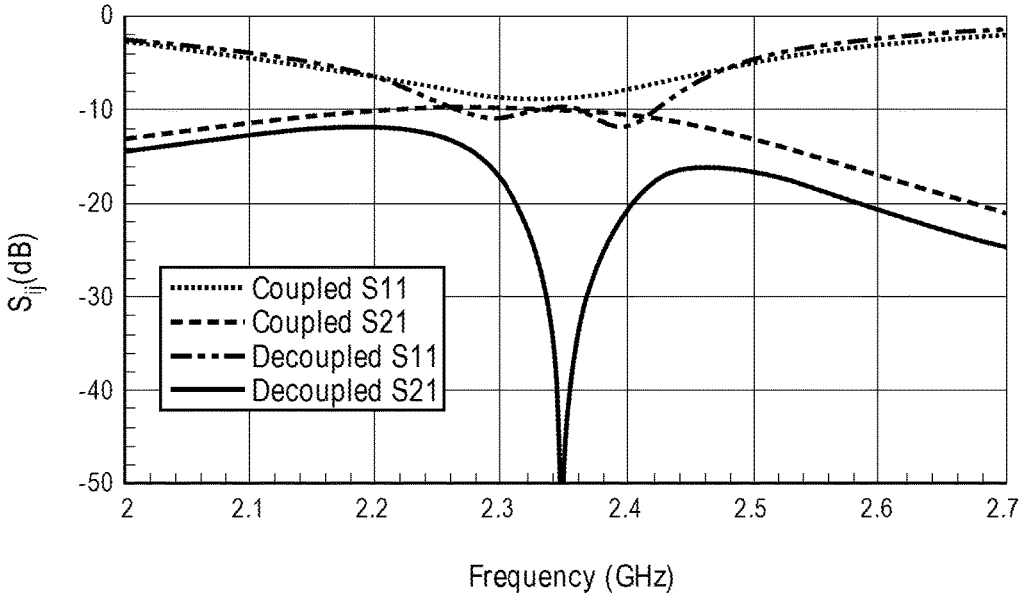

FIG. 29 illustrates the simulated S-parameters of two coupled and decoupled semi-loop antennas with capacitive loads near the shorting ends as shown in FIG. 2.

Figure 3:
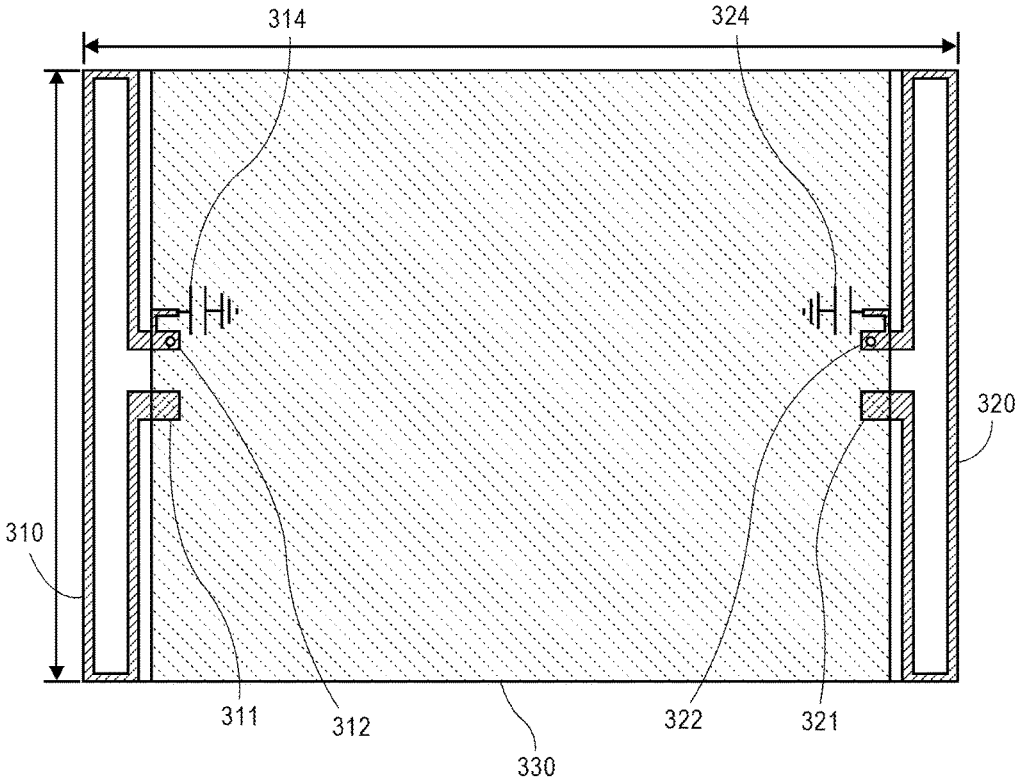
FIG. 3 illustrates a schematic view of two coupled loop antennas according to an embodiment of the present application.
Figure 30:
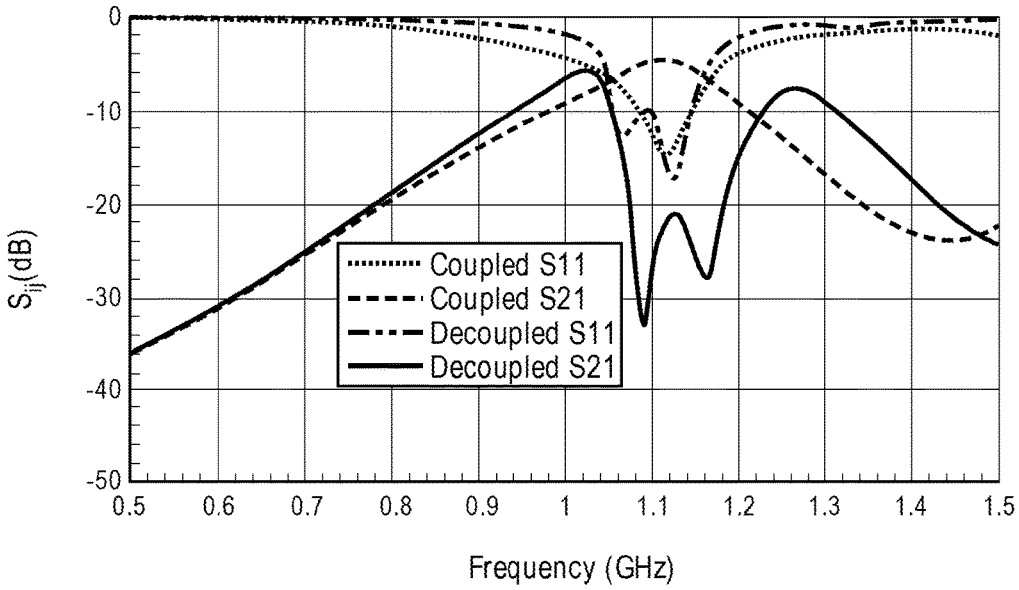

FIG. 30 illustrates the simulated S-parameters of two coupled and decoupled loop antennas with capacitive loads near the shorting ends as shown in FIG. 3.

Figure 4:
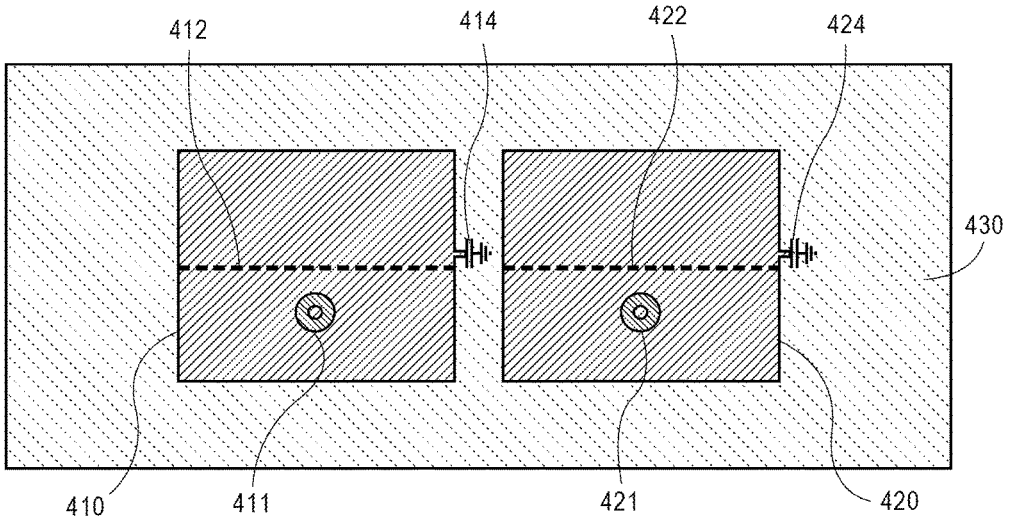
FIG. 4 illustrates a schematic view of two coupled patch antennas according to an embodiment of the present application.
Figure 31:
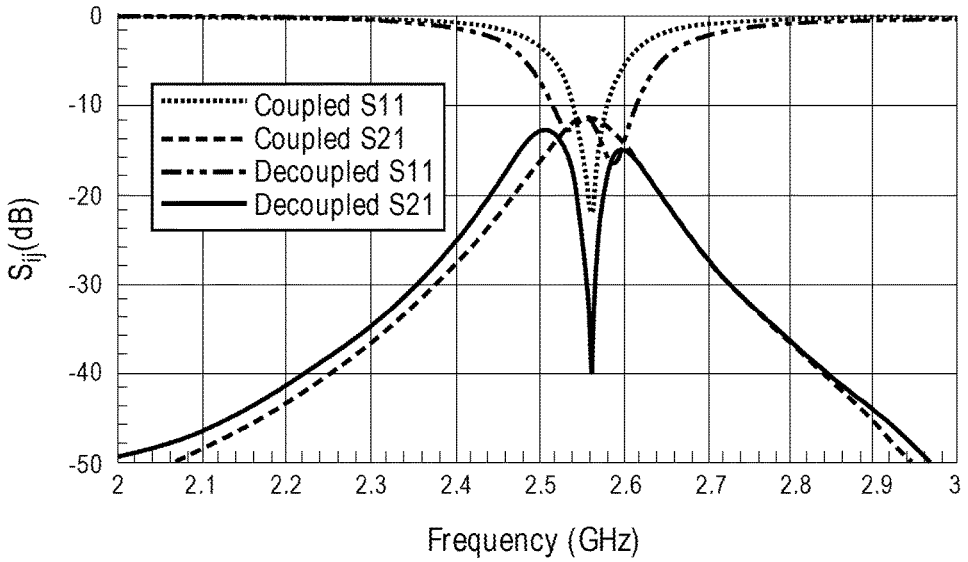

FIG. 31 illustrates the simulated S-parameters of two coupled and decoupled patch antennas with capacitive loads near the virtual short-circuit line as shown in FIG. 4.

Figure 32:
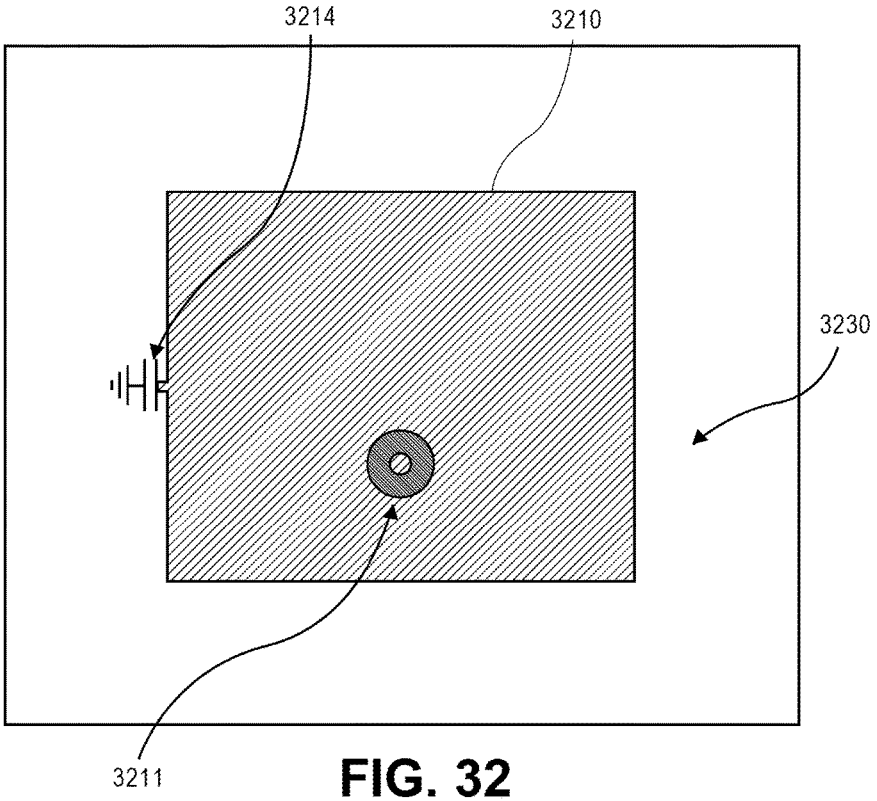

FIG. 32 shows the configurations of a patch antenna with a capacitive load.

Figure 33:
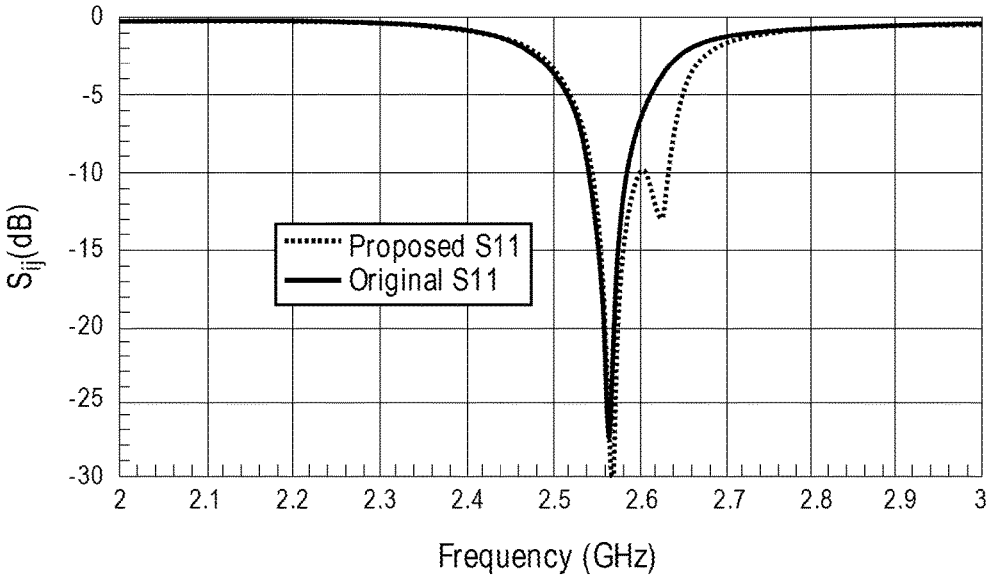

FIG. 33 illustrates the simulated S-parameters of a conventional patch antenna and its variation with a capacitive load as a wide-band patch antenna.

Figure 34:
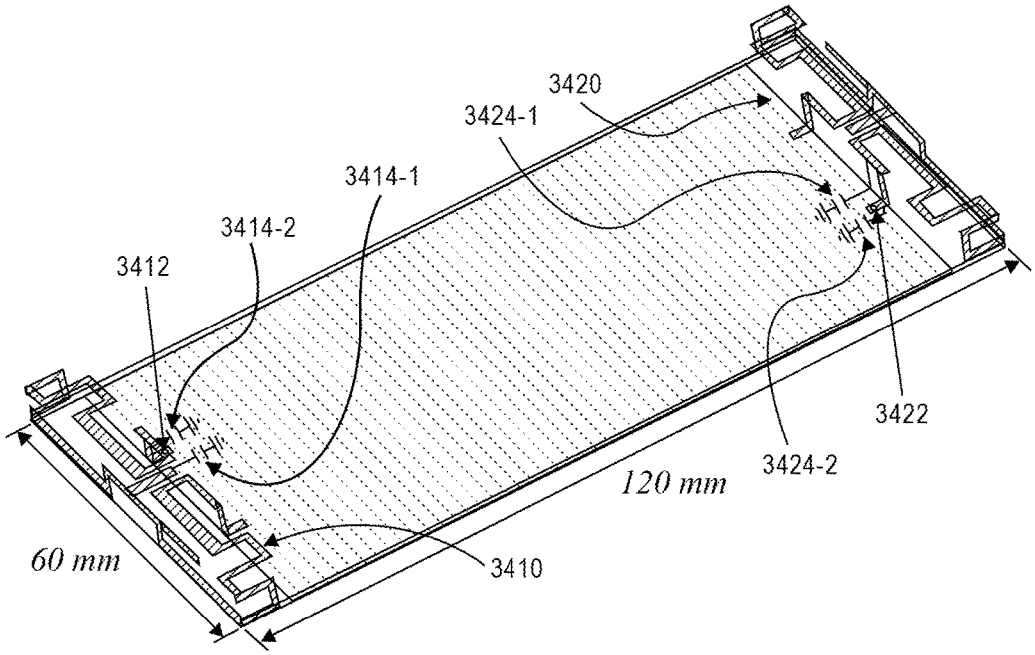

FIG. 34 illustrates the arrangements of two dual-band loop antennas, one on each end side of a grounded circuit board in which each of the two coupled loop antennas has two capacitive loads.

Figure 35:
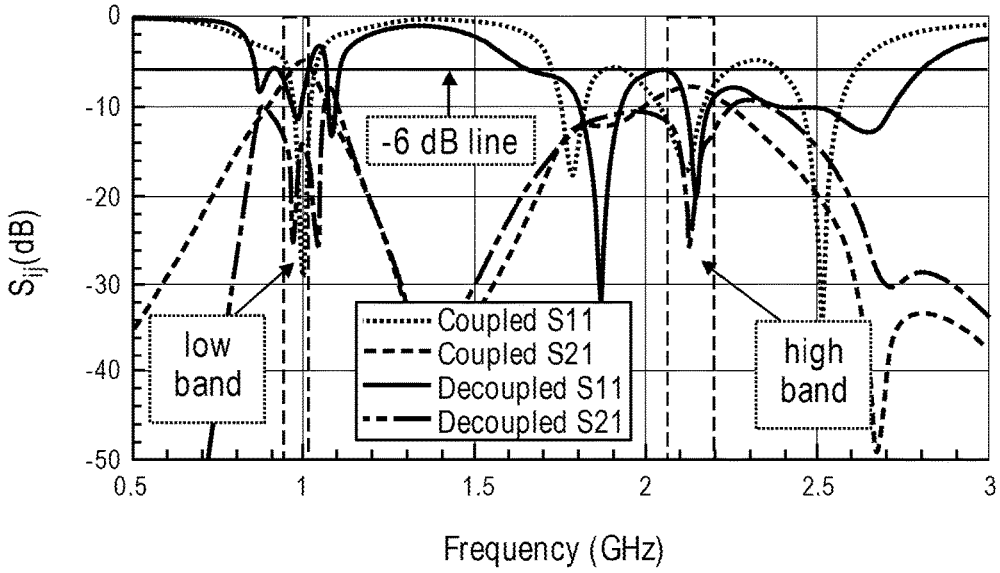

FIG. 35 illustrates the simulated S-parameters of the two coupled and decoupled dual-band loop antennas.

DETAILED DESCRIPTION

Hereinafter, the present application will be further explained in detail with reference to the accompanying drawings and embodiments. It should be understood that specific embodiments described herein intend to explain the relevant invention, rather than to limit the invention. In addition, it should be noted that only portions of the present invention are shown in the accompanying drawings for the ease of description.

According to an embodiment, an antenna assembly comprising at least two coupled antennas is provided, in which a capacitive load is provided to at least one of the coupled antennas so that the mutual coupling between the antennas is reduced. The antenna to which a capacitive load is provided may be an antenna in any practical form, including but not limited to an inverted-F antenna, a semi-loop antenna, a loop antenna and a patch antenna. The capacitive load is provided at a critical point of a coupled antenna. The critical point is selected so that the mutual coupling between the coupled antennas may be reduced. The critical point can be near the shorting end of the antenna. The shorting end may be either a physical shorting end or a virtual shorting end. For example, for an inverted-F antenna (IFA), a semi-loop antenna or a loop antenna, the critical point is near the physical shorting end of the IFA antenna, the semi-loop antenna or the loop antenna. For example, for a patch antenna, the critical point is near a virtual shorting point of the antenna. The virtual shorting point is a point of the antenna at which the voltage to the ground is zero.

Figure 1:
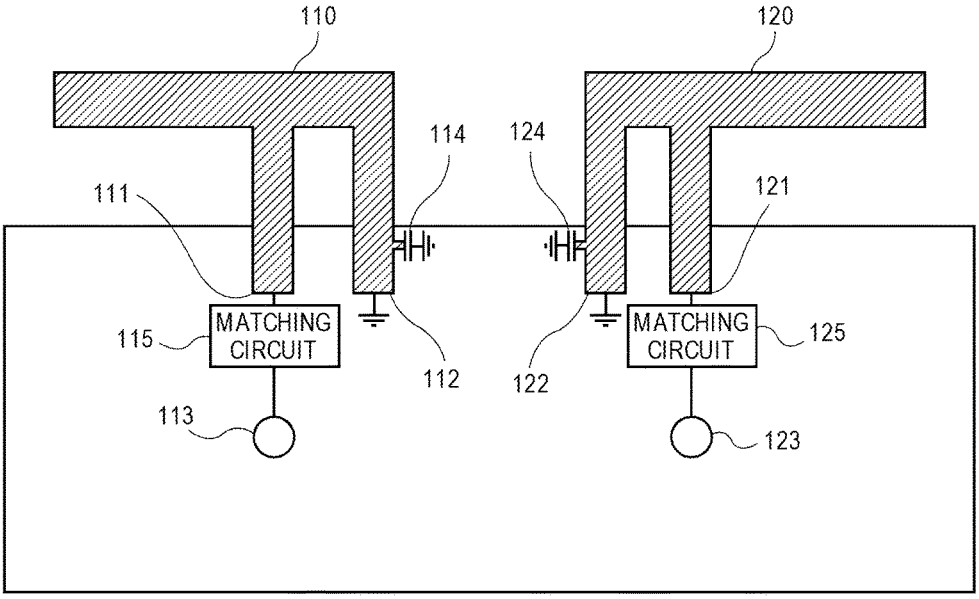
FIG. 1 illustrates a schematic view of two coupled IFA antennas according to an embodiment of the present application.

FIG. 1 illustrates a schematic view of two coupled IFA antennas. As shown in FIG. 1, each of an IFA antenna 110 and an IFA antenna 120 includes a feeding end and a shorting end. For example, the IFA antenna 110 includes a feeding end 111 and a shorting end 112, and the IFA antenna 120 includes a feeding end 121 and a shorting end 122. The IFA antenna 110 includes a feeding port 113 at the feeding end 111. The IFA antenna 120 includes a feeding port 123 at the feeding end 121. According to the present application, a capacitive load is provided to at least one of the coupled IFA antennas at a critical location near the shorting end thereof. For example, capacitive loads 114 and 124 may be provided at the IFA antenna 110 and the IFA antenna 120 at critical locations near the shorting end 112 and the shorting end 122, respectively. The capacitive load may be provided at the end of a tapping stub near the shorting end, and may be provided in the form of a distributed circuit. The location and the capacitive load value may be adjusted to achieve a high isolation among the coupled antennas at the desired frequency. Afterwards, an optional matching circuit may be needed at each feeding port. For example, matching circuits 115 and 125 may be provided at the feeding ends 111 and 121, respectively.

It is noted that, although each of the coupled antennas as shown is provided with a capacitive load, it is possible that only one of the coupled antennas is provided with the capacitive load.

FIG. 2 illustrates a schematic view of two coupled semi-loop antennas. As shown in FIG. 2, each of a semi-loop antenna 210 and a semi-loop antenna 220 includes a feeding port and a shorting end. For example, the semi-loop antenna 210 includes a feeding port 211 and a shorting end 212, and the semi-loop antenna 220 includes a feeding port 221 and a shorting end 222. According to the present application, a capacitive load is provided to at least one of the coupled semi-loop antennas near the shorting end thereof. For example, capacitive loads 214 and 224 may be provided at the semi-loop antenna 210 and the semi-loop antenna 220 near the shorting end 212 and the shorting end 222, respectively. The capacitive load may be provided at the end of a tapping stub near the shorting end, and may be provided in the form of a distributed circuit. The location and the load value may be adjusted to achieve a high isolation among the coupled antennas at the desired frequency band.

It is noted that, although each of the coupled antennas as shown are provided with a capacitive load, it is possible that only one of the coupled antennas is provided with the capacitive load.

FIG. 3 illustrates a schematic view of two coupled loop antennas. As shown in FIG. 3, each of a loop antenna 310 and a loop antenna 320 includes a feeding port and a shorting end. For example, the loop antenna 310 includes a feeding port 311 and a shorting end 312, and the loop antenna 320 includes a feeding port 321 and a shorting end 322. According to the present application, a capacitive load is provided to at least one of the two loop antennas near the shorting end thereof. For example, capacitive loads 314 and 324 may be provided at the loop antenna 310 and the loop antenna 320 near the shorting end 312 and the shorting end 322, respectively. The capacitive load may be provided at the end of a tapping stub near the shorting end, and may be provided in the form of a distributed circuit. The location and the load value may be adjusted to achieve a high isolation among the coupled antennas at the desired frequency.

It is noted that, although each of the coupled antennas as shown are provided with a capacitive load, it is possible that only one of the coupled antennas is provided with the capacitive load.

FIG. 4 illustrates a schematic view of two coupled patch antennas. As shown in FIG. 4, a patch antenna 410 has a feeding point 411 and a virtual short-circuit line 412, and a patch antenna 420 has a feeding point 421 and a virtual short-circuit line 422. According to the present application, a capacitive load is provided to at least one of the two patch antennas near the virtual short-circuit line. For example, capacitive loads 414 and 424 may be provided at the patch antenna 410 and the patch antenna 420 near the virtual short-circuit lines 412 and 422, respectively. The capacitive load may be provided at the end of a tapping stub near the virtual short-circuit line, and may be provided in the form of a distributed circuit. The location and the value of the capacitive load may be adjusted to achieve a high isolation among the coupled antennas at the desired frequency.

It is noted that, although each of the coupled antennas as shown are provided with a capacitive load, it is possible that only one of the coupled antennas is provided with the capacitive load.

According to embodiments, the coupled antennas may work in the same frequency band or in adjacent frequency bands, for example LTE Band 40 (2.3 GHz-2.4 GHz) and frequency band for IEEE 802.11/b (2.4 GHz-2.4835 GHz). According to an embodiment, at least one of the coupled antennas may be a multi-band antenna. According to an embodiment, the capacitive load is a variable capacitive load. When the coupled antennas work in multiple frequency bands, the method can be applied to mitigate the mutual couplings in the desired frequency bands. In one embodiment, the method is used to reduce the mutual coupling at a low frequency band of two coupled antennas while leaving the performance of the two antennas at high frequency bands nearly unaffected. In one embodiment, the method is used to reduce the mutual coupling in more than one frequency bands of two coupled antennas by providing more than one capacitive loads to at least one coupled multiple band antenna at more than one critical points.

Comparing to all the existing decoupling methods, in which a device or a structure must be connected or introduced between the coupled antennas, the antenna assembly and the decoupling method provided in the present application do not require any of a device or a structure introduced between coupled antennas. Since the capacitive load is usually very small and thus the size thereof may be almost ignored. In this regard, this is a self-curing decoupling method, which introduces an additional current component on one or more coupled antennas. The current component generates the signal that is with the same magnitude but opposite phase of the unwanted interference signal at the coupled antenna ports to cancel out the interference signal. In addition, the introduced capacitive load also plays a role of increasing the impedance matching bandwidth.

Four most distinct and attractive features of this self-curing decoupling method are: 1) no any component that connects or structure between coupled antennas are required; 2) the capacitive load is very little frequency dependent so that the method is highly suitable for antenna decoupling at low frequencies; 3) the required capacitive load takes almost no space in the circuit layout; and 4) the load does not noticeably change antenna radiation patterns. As a result, the antenna assembly and the decoupling method provided in the present application are most practical to implement among all the existing decoupling methods and its electric performance is optimal.

It is noted that, although four kinds of antennas with the capacitive load to reduce mutual coupling are provided as examples, the present application may also be applied to other antennas, as long as the capacitive load is provided at a selected critical position. For example, the critical position may be near the shorting end of the antenna. The shorting end may be either a physical shorting end or a virtual shorting end. For an antenna having a physical shorting end, the capacitive load may be provided near the physical shorting end. For an antenna without a physical shorting end, the capacitive load may be provided near the virtual shorting end. It is known that the virtual shorting end is a point of the antenna where the voltage to the ground is zero.

In addition, although two antennas are shown in the drawings to consider the mutual coupling between the two antennas, it is noticed that the technical solution of the present application may also be used for more than two antennas.

In another aspect, the present application provides an antenna with broadened and/or variable frequency band. The broadened frequency band may be dual-band or wideband. According to the present application, the antenna with broadened and/or variable frequency band includes a capacitive load provided at a position near a shorting end of the antenna. The shorting end may be a physical shorting end or a virtual shorting end. For an antenna having a physical shorting end, the capacitive load may be provided near the physical shorting end. For an antenna without a physical shorting end, the capacitive load may be provided near the virtual shorting end. The antenna may be in the form of, but not limited to, an inverted-F antenna, a semi-loop antenna, a loop antenna and a patch antenna. The capacitive load may be provided at an end of a tapping stub at the position near the shorting end of the antenna, and may be provided in the form of a distributed circuit. When the capacitive load is a tunable capacitive load, the antenna is implemented as an antenna with a variable frequency band.

Figure 5:
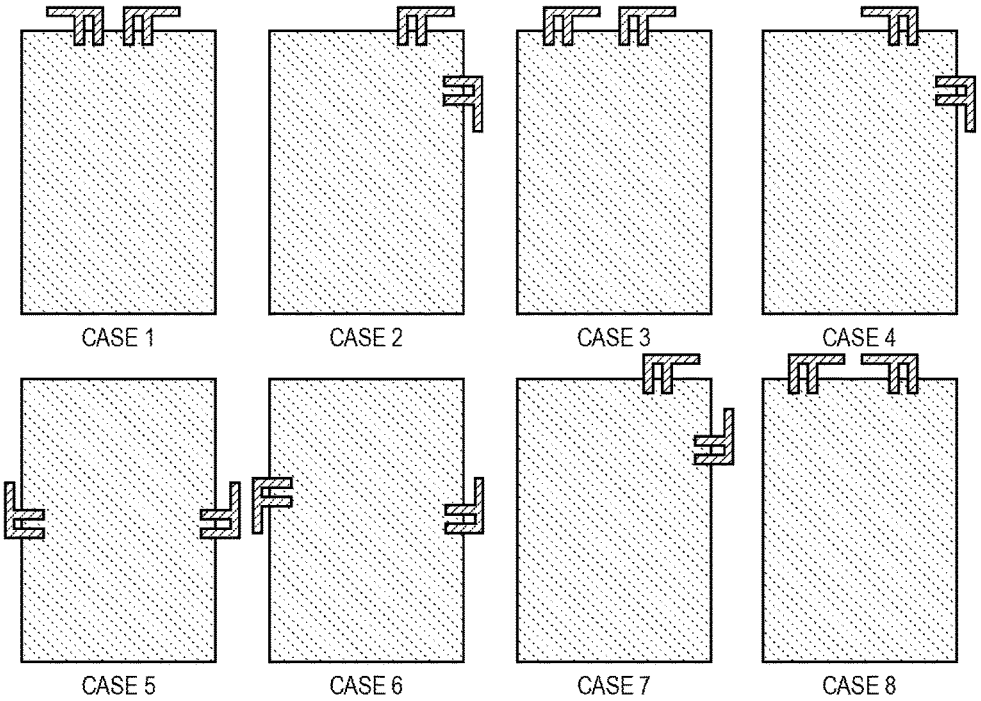
FIG. 5 shows the position and orientation combinations of two IFA antennas on the periphery of a wireless terminal system circuit board.

To demonstrate the decoupling method, several practical position and orientation combinations of two IFA antennas on the periphery of a wireless terminal system circuit board are investigated. Hereinafter, taking the IFA antenna as an example, experiments are conducted for different practical arrangements of two IFA antennas. The position and orientation combinations are shown in FIG. 5. Cases 1 and 2 are designed, simulated using EM simulation software and measured to experimentally prove the concept of the decoupling method. The rest of cases are investigated by EM simulation.

Case 1

Figure 6:
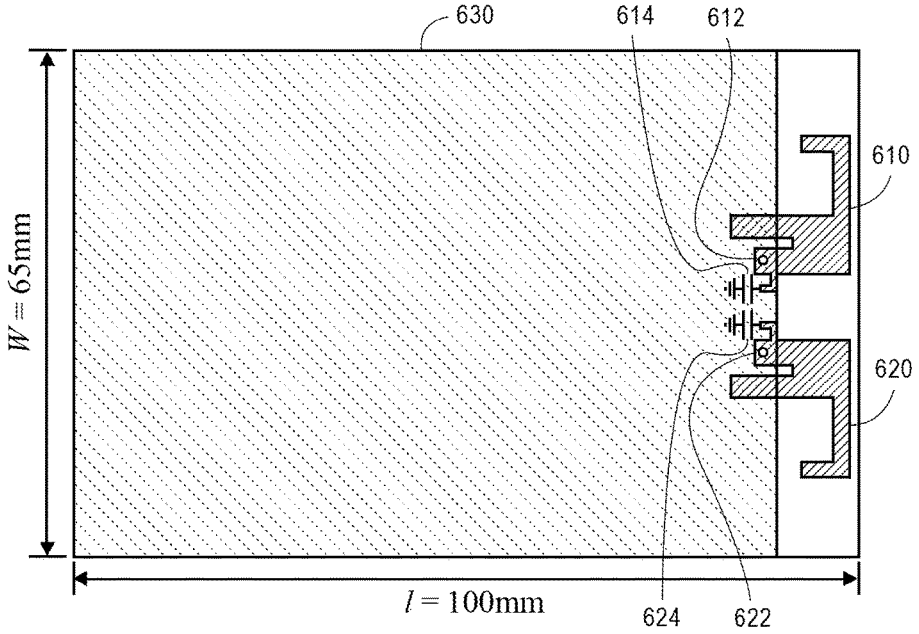
FIG. 6 illustrates the tail-to-tail arrangement of two IFA antennas on the same edge in case 1 with capacitive loads.

FIG. 6 illustrates the tail-to-tail arrangement of two IFA antennas on the same edge in case 1 with capacitive loads. As shown, two IFA antennas 610 and 620 are provided at the same side (w direction) on a PCB board 630. The two IFA antennas 610 and 620 are provided with capacitive loads 614 and 624 near the shorting ends 612 and 622, respectively.

Figure 7A:
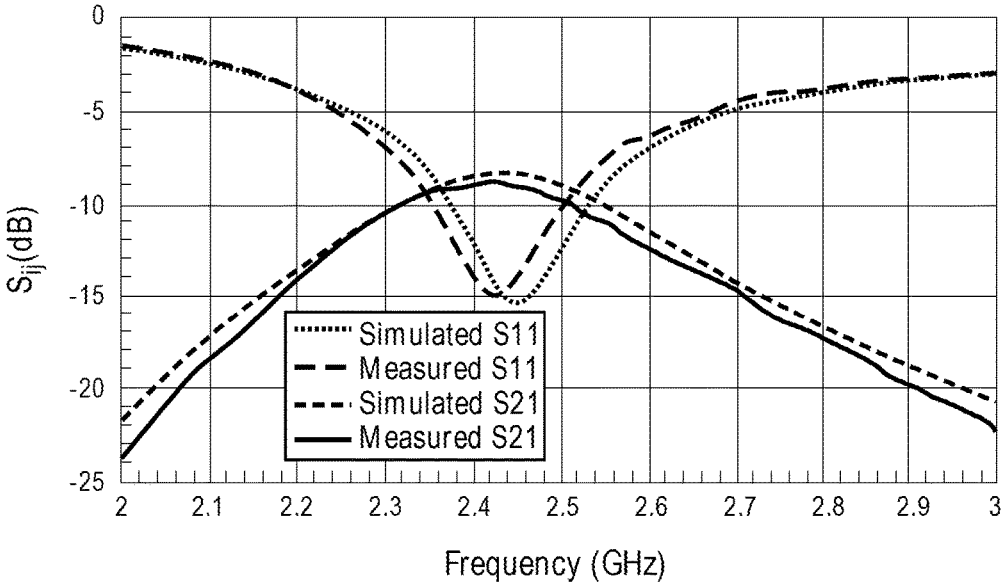
FIG. 7(*a*) illustrates the simulated and measured S-parameters of two tail-to-tail IFA antennas on the same edge without the capacitive loads.
Figure 7B:
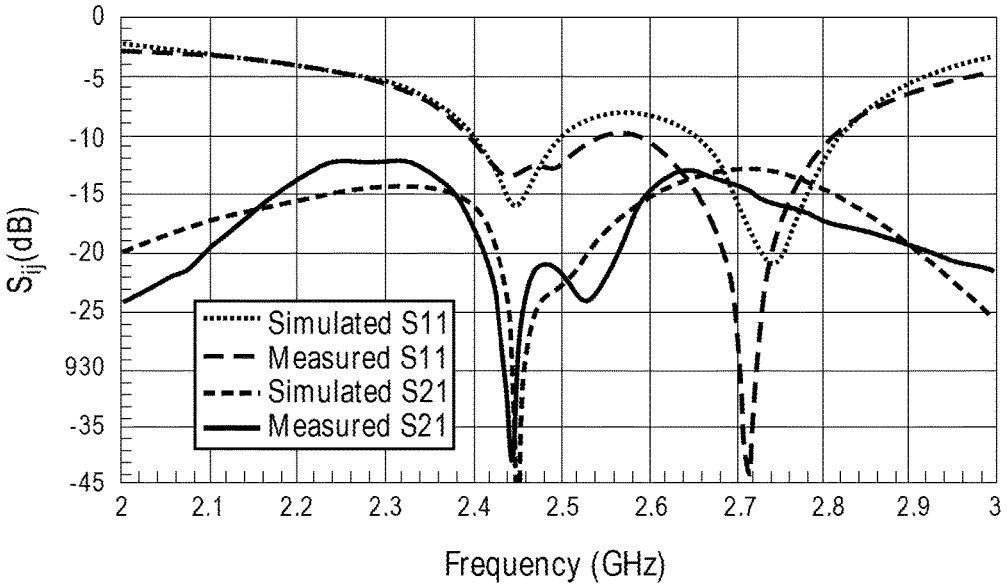
Figure 8A:
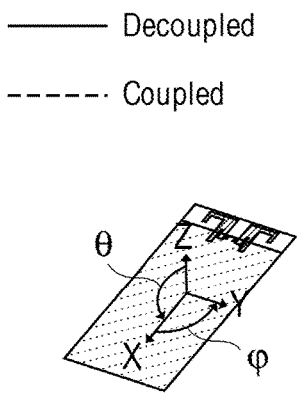
FIG. 8(*a*) illustrates a coordinate system to consider the measured radiation patterns of the coupled and decoupled antennas in case 1.
Figure 8B:
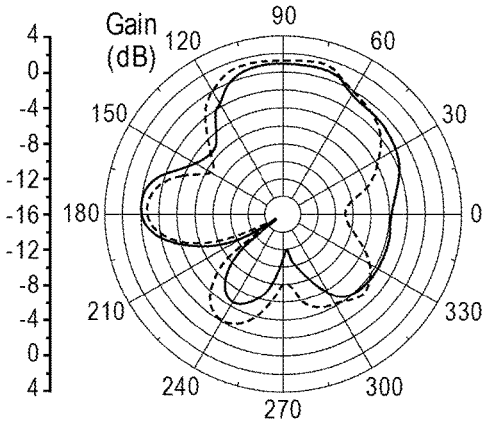
Figure 8C:
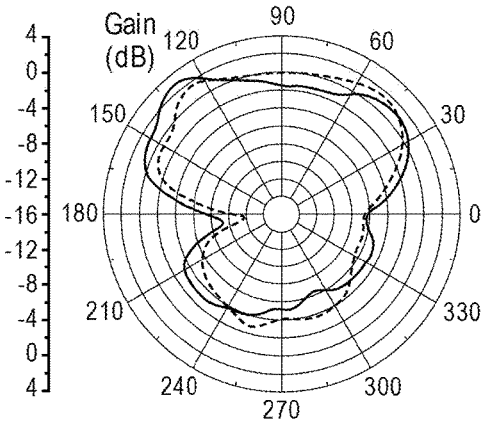
Figure 8D:
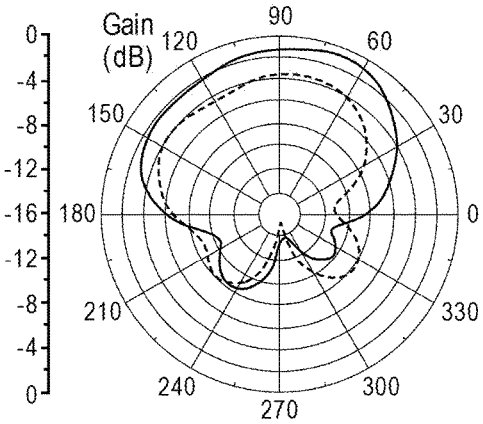

FIG. 7(*a*) illustrates the simulated and measured S-parameters of the tail-to-tail IFA antennas on the same edge without the capacitive loads. FIG. 7(*b*) illustrates the simulated and measured S-parameters of two tail-to-tail IFA antennas on the same edge with the capacitive loads. It is observed that the simulated and measured results agree very well and the measured isolation at the 2.45 GHz is enhanced from about 8 dB to better than 35 dB while the return loss is better than 10 dB with a wider bandwidth than that of the coupled antennas without capacitive load if a simple matching circuit is used on each antenna.

FIG. 8(*a*) illustrates a coordinate system to consider the measured radiation patterns of the coupled and decoupled antennas in case 1. FIGS. 8(*b*), 8(*c*) and 8(*d*) illustrate the measured radiation patterns of the coupled and decoupled antennas in case 1 in the x-y plane ($\theta$=90° plane), x-z plane ($\varphi$=0° plane) and y-z plane ($\varphi$=90° plane), respectively.

In the measurement, antenna 620 is excited while antenna 610 is terminated with a matched load. One observation is that the radiation patterns of the decoupled case will not change too much as compared to those of the coupled antennas. This is understandable since the mutual coupling between the two antennas is a second order effect in the radiation characteristics. This feature is desirable in practical applications.

FIG. 9 illustrates a comparison between the measured total efficiency of the coupled and decoupled IFA antennas in case 1. For the coupled antennas, the total efficiency is about 53% and for the decoupled ones, the total efficiency has improved to about 61% at 2.45 GHz. This is easy to understand because the strong coupling between the two IFA antennas leads to the coupled antenna becoming a load that absorbs the transmitted energy of another antenna.

FIG. 10 illustrates the measured Envelope Correlation Coefficient (ECC) of the coupled and decoupled IFA antennas in case 1. It is known that Envelope Correlation Coefficient (ECC) is an important figure of merit for a MIMO system. A low ECC means low correlation of two antennas and leads to a higher throughput and a better diversity gain as compared to the case with a higher ECC. The ECC for the coupled and decoupled IFA antennas of case 1 is calculated using the measured 3-D vector far-field radiation patterns. As shown in FIG. 10, a significant improvement for ECC is achieved with this decoupling method.

Case 2

FIG. 11 illustrates the head-to-tail arrangement of two IFA antennas on two perpendicular edges in case 2 with capacitive loads. As shown, two IFA antennas 1110 and 1120 are provided at two perpendicular edges (l direction and w direction) on a PCB board. The two IFA antennas 1110 and 1120 are provided with capacitive loads 1114 and 1124 near the shorting ends 1112 and 1122, respectively.

FIG. 12(*a*) illustrates the simulated and measured S-parameters of two head-to-tail IFA antennas on two perpendicular edges without the capacitive loads. FIG. 12(*b*) illustrates the simulated and measured S-parameters of two head-to-tail IFA antennas on two perpendicular edges with the capacitive loads. It is observed that the measured isolation at 2.45 GHz is enhanced from about 10 dB to better than 20 dB while the return loss at ports 1 and 2 is better than 10 dB if a simple matching circuit is applied to antenna 1120.

Case 3

FIG. 13 illustrates the head-to-tail arrangement of two IFA antennas on the same edge in case 3 with capacitive loads. As shown, two IFA antennas 1310 and 1320 are located on the same side (w direction) on a PCB board. The two IFA antennas 1310 and 1320 are provided with capacitive loads 1314 and 1324 near the shorting ends 1312 and 1322, respectively.

FIG. 14 illustrates the simulated S-parameters of coupled and decoupled two head-to-tail IFA antennas on the same edges. It is seen that the isolation at 2.45 GHz is improved from about 7 dB to better than 30 dB while the return loss is better than 10 dB from 2.4 GHz to 2.5 GHz if a simple matching circuit is applied to each antenna.

Case 4

FIG. 15 illustrates the tail-to-tail arrangement of two IFA antennas on two perpendicular edges in case 4 with capacitive loads. As shown, two IFA antennas 1510 and 1520 are located on two perpendicular edges (l direction and w direction) on a PCB board. The two IFA antennas 1510 and 1520 are provided with capacitive loads 1514 and 1524 near the shorting ends 1512 and 1522, respectively.

FIG. 16 illustrates the simulated S-parameters of coupled and decoupled two tail-to-tail IFA antennas on two perpendicular edges. It is seen that the isolation at 2.45 GHz is enhanced from about 13 dB to better than 30 dB while the return loss is better than 10 dB from 2.4 GHz to 2.5 GHz if a simple matching circuit is applied to each antenna.

Case 5

FIG. 17 illustrates the arrangement of two IFA antennas in the same orientation and on two opposite edges in case 5 with capacitive loads. As shown, two IFA antennas 1710 and 1720 are located on two opposite edges (both in l direction)

on a PCB board in the same orientation. The two IFA antennas 1710 and 1720 are provided with capacitive loads 1714 and 1724 near the shorting ends 1712 and 1722, respectively.

FIG. 18 illustrates the simulated S-parameters of coupled and decoupled two IFA antennas in the same orientation and on two opposite edges. It is seen that the isolation at 2.45 GHz is enhanced from about 11 dB to better than 24 dB while the return loss is better than 10 dB from 2.4 GHz to 2.5 GHz if a simple matching circuit is applied to each antenna.

Case 6

FIG. 19 illustrates the arrangement of two IFA antennas in opposite orientations and on two opposite edges in case 6 with capacitive loads. As shown, two IFA antennas 1910 and 1920 are located on two opposite edges (both in l direction) on a PCB board in opposite orientations. The two IFA antennas 1910 and 1920 are provided with capacitive loads 1914 and 1924 near the shorting ends 1912 and 1922, respectively.

FIG. 20 illustrates the simulated S-parameters of coupled and decoupled two IFA antennas in opposite orientations and on two opposite edges. It is seen that the isolation at 2.45 GHz is enhanced from about 13 dB to better than 25 dB while the return loss is better than 10 dB from 2.4 GHz to 2.5 GHz if a simple matching circuit is applied to each antenna.

Case 7 and Case 8 are Similar to Case 2 and Case 1 Respectively.

The experiments above are for antennas working in the same frequency band. The decoupling method and the antenna assembly according to the present application are also applicable to two IFA antennas working in two adjacent frequency bands. FIG. 21 shows the simulated S-parameters of two coupled and decoupled IFA antennas working in LTE Band 40 (2.3 GHz-2.4 GHz) and frequency band for IEEE 802.11/b (2.4 GHz-2.484 GHz). It is shown that with a capacitor loaded on each IFA antenna, the isolation at the adjacent frequency 2.4 GHz is improved from about 8 dB to better than 35 dB and the return loss is better than 10 dB in the two frequency bands.

The decoupling method and the antenna assembly according to the present application are also applicable to two dual-band IFA antennas working in same frequency bands. FIG. 22 illustrates the same edge tail-to-tail arrangement of two dual-band IFA antennas 2210 and 2220 with capacitive loads. The two dual-band IFA antennas 2210 and 2220 are provided with capacitive loads 2214 and 2224 near the shorting ends 2212 and 2222, respectively. Two typical dual-band IFA antennas working at frequency 2.45 GHz and 5.25 GHz are shown in FIG. 22. In common practice, the coupling at high frequency is usually much smaller than that at low frequency. In one embodiment, this decoupling method focuses on improving the isolation at the low frequency whereas keeping the characteristics at the high frequency nearly unaffected.

FIG. 23 illustrates the simulated S-parameters of two coupled and decoupled tail-to-tail on same edge dual-band IFA antennas. As the simulated S-parameters shown in FIG. 23, with a 0.9 pF capacitive load, the isolation at 2.45 GHz is improved from about 10 dB to 28 dB and the return loss deteriorates to about 5 dB, but the isolation and return loss at 5.25 GHz band are not affected too much. This is easy to understand since the 0.9 pF capacitor can't tune the current distribution at 5.25 GHz as effectively as that at 2.45 GHz. A LI matching network is designed to re-match the decoupled antennas. The S-parameters with re-matched antennas are shown in FIG. 23. The isolation at 2.45 GHz is enhanced from about 10 dB to better than 25 dB while the return loss is better than 10 dB from 2.4 GHz to 2.5 GHz. As expected, the isolation at 5.25 GHz is about 20 dB while the return loss is better than 10 dB from 5 GHz to 5.5 GHz, which is about the same as that before adding the capacitive loads and re-matching.

According to the present application, an antenna with a capacitive load may also be used for multi-band and wide-band applications. In this embodiment, the capacitive load provided at a position near a shorting end of the antenna. The shorting end is a physical shorting end or a virtual shorting end. For an antenna having a physical shorting end, the capacitive load may be provided near the physical shorting end. For an antenna without a physical shorting end, the capacitive load may be provided near a virtual shorting end. The antenna may be in the form of, but not limited to, an inverted-F antenna, a semi-loop antenna, a loop antenna and a patch antenna. The capacitive load may be provided at an end of a tapping stub at the position near the shorting end of the antenna, and may be provided in the form of a distributed circuit. Where the capacitive load is a tunable capacitive load, the antenna is implemented as an antenna with a variable frequency band.

According to the present application, an antenna with a capacitive load may also be used as an antenna with tunable frequency band. In this embodiment, the capacitive load is a tunable capacitive load.

FIG. 24(*a*) illustrates the configurations of an IFA antenna 2410 with a capacitive load 2414 for dual-band applications; and FIG. 24(*b*) illustrates the configurations of an IFA antenna 2420 with a capacitive load 2424 for wide-band applications. In FIG. 24(*a*), a capacitive load 2414 is provided near the shorting end 2412. In FIG. 24(*b*), a capacitive load 2424 is provided near the shorting end 2422. For a wide-band application, a matching circuit 2425 may be needed at the antenna port 2423, whereas no matching circuit is needed for a dual-band case at the feeding port 2413. However, for all embodiments in the application, the matching circuit is optional. The matching circuit may improve the matching performance of the antenna. However, it is also possible that the matching condition is improved by fine adjusting the antenna dimensions so that no matching circuit is needed.

FIG. 25 illustrates the simulated S-parameters of a conventional IFA antenna and its variation with a capacitive load as a dual-band IFA antenna. With an appropriate capacitive load at a critical point on the shorting arm of a conventional single band IFA antenna, a dual-band IFA antenna can be achieved. As the simulated and measured S-parameters shown in FIG. 25, with a 0.8 pF capacitor loaded at the shorting arm of an IFA antenna, the IFA antenna now works at 2.2 GHz band and 2.5 GHz band.

FIG. 26 illustrates the measured total efficiency of the dual-band IFA antenna with capacitive load. With a capacitive load at the shorting arm of the IFA antenna, quite good radiation performance is achieved in both frequency bands.

FIG. 27 illustrates the simulated S-parameters of a conventional IFA antenna and its variation with a capacitive load as a wide-band IFA antenna. With a capacitive load at the shorting arm of the IFA antenna, the 10 dB return loss bandwidth is about doubled as compared with that of the IFA antenna without the capacitive load.

FIG. 28 illustrates the simulated S-parameters of a conventional IFA antenna and its variation with a tunable capacitive load as a tunable IFA antenna. For a given proper capacitor, this IFA antenna presents dual-band characteristics as illustrated in FIG. 28. By increasing the value of the capacitor, the two resonant frequencies of the antenna both decreases. However, the high frequency is always close to the original frequency of the single frequency band conventional IFA antenna. A large tunable range for the low frequency can be observed. This feature is very useful for a frequency-tunable IFA antenna in the low frequency band.

FIG. 29 illustrates the simulated S-parameters of two coupled and decoupled semi-loop antennas using the proposed capacitive loads near the shorting ends as shown in FIG. 2. Semi-loop means the feeding position is far from the shorting position so that the antenna configuration is just a semi-loop in physical meaning. In this case, the ground plane serves as a part of the loop. A decoupling capacitive load is provided at an appropriate position near the shorting end of each semi-loop antenna. As the simulated S-parameters shown in FIG. 29, the isolation at 2.35 GHz is enhanced from about 10 dB to better than 30 dB while the return loss is better than 10 dB from 2.3 GHz to 2.4 GHz (LTE band 40).

FIG. 30 illustrates the simulated S-parameters of two coupled and decoupled loop antennas using the proposed capacitive loads near the shorting ends as shown in FIG. 3. A decoupling capacitive load is provided at an appropriate position near the shorting end of each loop antenna. As the simulated S-parameters shown in FIG. 30, the isolation at 1.115 GHz is enhanced from about 5 dB to better than 20 dB while the matching condition is better than that of the coupled loop antennas without capacitive load.

FIG. 31 illustrates the simulated S-parameters of two coupled and decoupled patch antennas using the proposed capacitive loads near the virtual short-circuit line as shown in FIG. 4. As the simulated S-parameters shown in FIG. 31, the isolation at 2.566 GHz is enhanced from about 12 dB to better than 35 dB while the matching bandwidth is much wider than that of the coupled patch antennas without capacitive load.

FIG. 32 shows the configurations of a patch antenna with a capacitive load.

FIG. 32 shows the basic configuration of a conventional patch antenna 3210 on the ground 3230 with a capacitive load 3214 for a wide-band application. A feeding point 3211 is also shown in FIG. 32. FIG. 33 illustrates the simulated S-parameters of a conventional patch antenna and its variation with a capacitive load as a wide-band patch antenna. With a capacitive load added near a virtual short-circuit point of the patch antenna, the 10 dB return loss bandwidth is about doubled as compared with that of the patch antenna without capacitive load.

According to a further embodiment, the antenna assembly may include two dual-band antennas working in the same frequency bands, in which two capacitive loads are provided to at least one of the coupled antennas to reduce the mutual coupling in the two frequency bands between the antennas. The antenna to which the capacitive loads are provided may be an antenna in any practical form, including but not limited to an inverted-F antenna, a semi-loop antenna, a loop antenna and a patch antenna. The capacitive loads are provided at the points of a coupled antenna, at which the mutual couplings at two designated frequency bands are significantly reduced. The points can be near the shorting end of an inverted-F antenna (IFA), near the shorting end of a semi-loop antenna or a loop antenna, or near a virtual short-circuit point of an antenna where the voltage to the ground is zero.

FIG. 34 illustrates the arrangements of two dual-band loop antennas, one on each end side of a grounded circuit board in which each of the two coupled loop antennas has two capacitive loads. Two typical dual band loop antennas working at frequency 0.96 GHz and 2.1 GHz are shown in FIG. 34. There are two capacitors loaded at each loop antenna. The two capacitors for different antennas could be different. Capacitive load 3414-1 of 2.2 pF and capacitive load 3414-2 of 0.8 pF are provided to antenna 3410 near the shorting end 3412 of antenna 3410 and capacitive load 3424-1 of 2.7 pF and capacitive load 3424-2 of 0.8 pF are provided to antenna 3420 near the shorting end 3422 of antenna 3420. Capacitive loads 3414-1 and 3424-1 are used to reduce the mutual coupling between the two antennas at 0.96 GHz and capacitive loads 3414-2 and 3424-2 are used to reduce the coupling at 2.1 GHz.

FIG. 35 illustrates the simulated S-parameters of the two coupled and decoupled dual-band loop antennas. The simulated S-parameters shown in FIG. 35 show that, with capacitive load 3414-1 of 2.2 pF and capacitive load 3414-2 of 0.8 pF at antenna 3410 near the shorting end 3412 of antenna 3410 and capacitive load 3424-1 of 2.7 pF and capacitive load 3424-2 of 0.8 pF at antenna 3420 near the shorting end 3422 of antenna 3420, the isolation parameter S21 is improved from about 5 dB to 15 dB at 0.96 GHz and from 8 dB to 20 dB at 2.1 GHz. With a typical L-type matching circuit at the original antenna feeding ports, the matching conditions maintain at the same level as the coupled case but with a wider impedance matching bandwidth for both antennas.

Although some embodiments of the present invention have been described, many modifications and changes may be possible once those skilled in the art get to know some basic inventive concepts. The appended claims are intended to be construed comprising these preferred embodiments and all the changes and modifications fallen within the scope of the present invention.

It will be apparent to those skilled in the art that various modifications and variations could be made to the present application without departing from the spirit and scope of the present invention. Thus, if any modifications and variations lie within the spirit and principle of the present application, the present invention is intended to include these modifications and variations.

The invention claimed is:

1. An antenna assembly, comprising:

a first antenna having a shorting arm;

a first tapping stub projecting from the shorting arm of the first antenna;

a second antenna having a shorting arm;

a second tapping stub projecting from the shorting arm of the second antenna; and a ground plane connecting the first antenna and the second antenna;

wherein a first lumped capacitor is connected between the first tapping stub and the ground plane, and a second lumped capacitor is connected between the second tapping stub and the ground plane, so that a mutual coupling between the first antenna and the second antenna is reduced.

2. The antenna assembly according to claim 1, wherein the shorting arm of the first antenna is a physical shorting arm, the first antenna being an inverted-F antenna, a semi-loop antenna, or a loop antenna.

3. The antenna assembly according to claim 1, wherein the shorting arm of the first antenna is a virtual shorting point, the first antenna being a patch antenna.

4. The antenna assembly according to claim 1, wherein the shorting arm of the second antenna is a physical shorting arm, the second antenna being an inverted-F antenna, a semi-loop antenna, or a loop antenna.

5. The antenna assembly according to claim 1, wherein the shorting arm of the second antenna is a virtual shorting point, the second antenna being a patch antenna.

6. The antenna assembly according to claim 1, wherein the first antenna and the second antenna work in an identical frequency band or in two adjacent frequency bands.

7. The antenna assembly according to claim 1, wherein at least one of the first antenna and the second antenna is a multiple-band antenna, and the first antenna and the second antenna work in at least one identical frequency band or adjacent frequency bands.

8. The antenna assembly according to claim 1, wherein the first lumped capacitor includes a variable capacitive load.

9. The antenna assembly according to claim 1, wherein the second lumped capacitor includes a variable capacitive load.

10. The antenna assembly according to claim 1, wherein the first antenna and the second antenna are dual-band antennas working in the same frequency bands, and a first additional lumped capacitor is connected between the first tapping stub and the ground plane so that mutual couplings between the first antenna and the second antenna in the frequency bands are reduced.

11. The antenna assembly according to claim 10, wherein at least one second additional lumped capacitor is connected between the second tapping stub and the ground plane so that the mutual couplings in the frequency bands between the first antenna and the second antenna are reduced.

12. A method for reducing mutual coupling of an antenna assembly including a first antenna having a shorting arm, a first tapping stub projecting from the shorting arm of the first antenna, a second antenna having a shorting arm, a second tapping stub projecting from the shorting arm of the second antenna, and a ground plane connecting the first antenna and the second antenna, the method comprising:

providing a first lumped capacitor between the first tapping stub and the ground plane; and providing a second lump capacitor between the second tapping stub and the ground plane, wherein the first and second lumped capacitors reduce mutual coupling between the first antenna and the second antenna.

13. The method according to claim 12, wherein the shorting arm of the first antenna is a physical shorting arm, the first antenna being an inverted-F antenna, a semi-loop antenna, or a loop antenna.

14. The method according to claim 12, wherein the shorting arm of the first antenna is a virtual shorting point the first antenna being a patch antenna.

15. The method according to claim 12, wherein the shorting arm of the second antenna is a physical shorting arm, the second antenna being an inverted-F antenna, a semi-loop antenna, or a loop antenna.

16. The method according to claim 12, wherein the shorting arm of the second antenna is a virtual shorting point, the second antenna being a patch antenna.

17. The method according to claim 12, wherein the first antenna and the second antenna work in an identical frequency band or in two adjacent frequency bands.

18. The method according to claim 12, wherein at least one of the first antenna and the second antenna is a multiple-band antenna, and the first antenna and the second antenna work in at least one identical frequency band or adjacent frequency bands.

19. The method according to claim 12, wherein the first lumped capacitor includes a variable capacitive load.

20. The method according to claim 12, wherein the second lumped capacitor includes a variable capacitive load.

21. The method according to claim 12, wherein the first antenna and the second antenna are dual-band antennas working in the same frequency bands, the method further comprising:

providing a first additional lumped capacitor connected between the first tapping stub and the ground plane so that mutual couplings between the first antenna and the second antenna in the frequency bands are reduced.

22. The method according to claim 21, further comprising:

providing at least one second additional lumped capacitor between the second tapping stub and the ground plane so that the mutual couplings between the first antenna and the second antenna in the frequency bands are reduced.

* * * * *